US008692188B2

(12) United States Patent
Webb

(10) Patent No.: US 8,692,188 B2
(45) Date of Patent: Apr. 8, 2014

(54) MASS SPECTROMETERS AND METHODS OF ION SEPARATION AND DETECTION

(75) Inventor: Brian Christopher Webb, Wiltshire (GB)

(73) Assignee: Ilika Technologies Limited, Hampshire (GB)

( * ) Notice: Subject to any disclaimer, the term of this patent is extended or adjusted under 35 U.S.C. 154(b) by 36 days.

(21) Appl. No.: 13/580,503

(22) PCT Filed: Nov. 10, 2010

(86) PCT No.: PCT/GB2010/002063

§ 371 (c)(1),
(2), (4) Date: Aug. 22, 2012

(87) PCT Pub. No.: WO2011/101607

PCT Pub. Date: Aug. 25, 2011

(65) Prior Publication Data

US 2012/0312982 A1 Dec. 13, 2012

(30) Foreign Application Priority Data

Feb. 22, 2010 (GB) ..... 1002967.6

(51) Int. Cl.
*H01J 49/26* (2006.01)

(52) U.S. Cl.
USPC ..... 250/282; 250/288; 250/293

(58) Field of Classification Search
USPC ..... 250/282
See application file for complete search history.

(56) References Cited

U.S. PATENT DOCUMENTS

| | | | | |
|---|---|---|---|---|
| 5,726,448 | A | 3/1998 | Smith | |
| 6,521,887 | B1 * | 2/2003 | Funsten et al. | 250/287 |
| 7,247,847 | B2 * | 7/2007 | Webb et al. | 250/293 |
| 2006/0138318 | A1 * | 6/2006 | Enke | 250/287 |
| 2009/0101813 | A1 | 4/2009 | Holle | |

FOREIGN PATENT DOCUMENTS

| | | |
|---|---|---|
| GB | 2219688 | 12/1989 |
| GB | 2376562 | 12/2002 |

OTHER PUBLICATIONS

UK Search Report for corresponding patent application No. GB1002967.6 dated Jun. 7, 2010.
International Search Report for corresponding patent application No. PCT/GB2010/002063 dated Feb. 15, 2011.

* cited by examiner

*Primary Examiner* — Phillip A. Johnston
(74) *Attorney, Agent, or Firm* — Renner, Otto, Boisselle & Sklar, LLP

(57) ABSTRACT

A mass spectrometer operating according to the iso-tach principle in which a mass filter accelerates ions to nominally equal velocities irrespective of their mass-to-charge ratios. The mass spectrometer is provided with an improved detector based on an electrostatic lens arrangement made of a concave lens followed in the beam path by a convex lens. These lenses deflect ions away from the beam axis by a distance from the beam axis that is inversely proportional to their mass-to-charge ratios. The mass-to-charge ratio of the ions can then be determined by a suitable detector array, such as a multi-channel plate placed in the beam path. This provides a compact and sensitive instrument.

12 Claims, 9 Drawing Sheets

MASS SPECTROMETERS AND METHODS OF ION SEPARATION AND DETECTION

This application is a national phase of International Application No. PCT/GB2010/002063 filed Nov. 10, 2010 and published in the English language.

BACKGROUND OF THE INVENTION

The invention relates to mass spectrometers and also to methods of ion separation and ion detection for use with mass spectrometers.

A mass spectrometer is capable of ionising a neutral analyte molecule to form a charged parent ion that may then fragment to produce a range of smaller ions. The resulting ions are collected sequentially at progressively higher mass/charge (m/z) ratios to yield a so-called mass spectrum that can be used to "fingerprint" the original molecule as well as providing much other information. In general, mass spectrometers offer high sensitivity, low detection limits and a wide diversity of applications.

There are a number of conventional configurations of mass spectrometers including magnetic sector type, quadrupole type and time of flight type. More recently, one of the present inventors has developed a new type of mass spectrometer that operates according to a different basic principle, as described in U.S. Pat. No. 7,247,847 [1], the full contents of which are incorporated herein by reference. The mass spectrometer of U.S. Pat. No. 7,247,847 accelerates all ion species to nominally equal velocities irrespective of their mass-to-charge ratios to provide a so-called constant velocity or iso-tach mass spectrometer. This is in contrast to time-of-flight mass spectrometers which aim to impart the same kinetic energy to all ion species irrespective of mass.

U.S. Pat. No. 7,247,847 discloses two principal embodiments which differ in respect of their detector designs. These two prior art designs are reproduced in FIGS. 1 and 2 of the accompanying drawings.

In both FIG. 1 and FIG. 2, a mass spectrometer 10 is shown comprising three main components connected serially, namely an ion source 12, a mass filter 14 (sometimes referred to as an analyser) and an ion detector 16.

In the FIG. 1 design, the ion detector 16 comprises a detector array 56 and an ion disperser to disperse the ions over the detector array according to their mass-to-charge ratios. The ion disperser comprises electrodes 52, 54 that produce a curved electric field which deflects the ions onto the array by amounts depending on their energies, which in turn depend on their mass-to-charge ratios. The least energetic (lowest mass) ions are deflected through the largest angle and the most energetic ions (highest mass) through the smallest angle. Consequently ions are dispersed spatially from left to right as viewing FIG. 1. It is noted that this type of dispersion ideally requires the ions to have an infinitely thin rectangular cross-section prior to deflection. In reality, the ion beam generated by the ion source 12 and mass filter 14 has a circular cross-section and this limits resolution of the detector. The resolution can be improved by clipping the ion beam with an ion absorbing slit placed in the beam path, but this means that some of the ions are lost to the detector, thereby reducing sensitivity. A trade-off between resolution and sensitivity thus pertains.

In the FIG. 2 design, an alternative ion detector 16 is used which comprises a first detector electrode 60 which is annular with an aperture for the passage of ions. This electrode 60 acts as an energy selector. Following this, a second detector electrode 62 is located in the ion path. This is a single element detector, such as a Faraday cup. A voltage supply 63 is provided for applying voltages to the first detector electrode 60 and the second detector electrode 62. In use, the first detector electrode 60 and the second detector electrode 62 are set to a potential of Vt+Vr volts, where Vt is the time varying voltage profile as defined above, and Vr is a bias voltage selected to repel, or reflect, ions having energies less than Vr electron volts. Hence, only ions having energies equal to or greater than Vr electron volts pass through the first detector electrode 60 and reach the second detector electrode 62 for detection.

To obtain a set of mass spectrum data, Vr is initially set to zero, so that all the ions in a packet are detected. For the next packet, Vr is increased slightly to reflect the lowest energy ions, and allow the remainder to be detected. This process is repeated, with Vr increased incrementally for each packet, until the field is such that all ions are reflected and no ions are detected. The data set of detected signals for each packet can then be manipulated to yield a plot of ion current against m/z ratios, i.e. the mass spectrum. This configuration allows for a simple and compact linear construction. However, the voltage sweeping process means that a large proportion of the ions is rejected, so sensitivity is reduced. The design also suffers from noise in that there is an uninterrupted direct path along the beam axis from the ion source 12 and mass filter 14 into the detector 16. Consequently, energetic photons produced inside the ion source are incident on the detector and can cause false counts. Moreover, non-ionised atoms and molecules, so-called neutrals, that are generated by energetic ions that pass sufficiently close to the grid to be discharged, but not significantly deflected off-axis, may also impinge on the detector and cause false counts.

It would therefore be desirable to improve the detector design of mass spectrometers operating according to the constant velocity or iso-tach principle.

SUMMARY OF THE INVENTION

According to a first aspect of the invention, a mass spectrometer is provided which comprises: an ion source operable to provide an ion beam comprising a plurality of ions, each having a mass-to-charge ratio; a mass filter arranged to receive the ion beam from the ion source and configured to eject ion packets in each of which the ions have nominally equal velocities irrespective of their mass-to-charge ratios, wherein the ion packets are ejected along a beam axis; and an ion detector arranged in the beam axis so as to receive the ion packets from the mass filter, wherein the ion detector comprises a lens arrangement operable to deflect ions away from the beam axis by a distance from the beam axis inversely proportional to their mass-to-charge ratios, and further comprises a position-sensitive sensor having a plurality of channels which lie at different distances away from the beam axis, so as to detect the mass-to-charge ratios of the ions according to their distances from the beam axis.

This design combines the advantages of the two prior art detector designs in that the instrument can be made compact, since the beam line is straight, and also sensitive, since all ions can be collected in parallel.

The term inversely proportional is used to indicate that higher mass-to-charge ratio ions are deflected less and lower mass-to-charge ratio ions are deflected more, not to indicate that the deflection follows any particular mathematical function.

The term position-sensitive sensor means an ion sensor capable of determining the location at which an ion has fallen on it, at least in one dimension or direction. For some embodiments, two-dimensional position sensitivity is necessary, whereas for other embodiments one-dimensional position sensitivity is adequate.

The lens arrangement comprises first and second lenses, one of which is preferably concave and the other convex. The concave lens is preferably arranged to receive the ions before the convex lens, i.e. upstream of the convex lens along the beam line.

The lenses may be spherical, thereby separating out ions radially about the beam axis according to their mass-to-charge ratios, or cylindrical, thereby separating out ions uniaxially about the beam axis according to their mass-to-charge ratios.

The lens arrangement and the position-sensitive sensor are preferably mutually arranged such that the ions pass through a focus between the lens arrangement and the position-sensitive sensor.

A beam stop may advantageously be arranged in the path of the deflected ions to filter out uncharged particles that have propagated along the beam axis unaffected by the lens arrangement. The beam stop is conveniently arranged between two lenses of the lens arrangement. As well as being useful for filtering out uncharged particles, the beam stop may be arranged and dimensioned to extend laterally from the beam axis so as to filter out ions having a mass-to-charge ratio above a maximum threshold value. A beam mask may also be arranged in the path of the deflected ions to filter out ions having a mass-to-charge ratio below a minimum threshold value. The beam mask may be co-planar with the beam stop, or at a different position along the beam line. Generally the beam mask will define an aperture for clipping part of the beam cross-section.

The mass filter is constructed in a preferred embodiment from an electrode arrangement and a drive circuit, the drive circuit being configured to apply a time varying voltage profile having a functional form that serves to accelerate the ions to nominally equal velocities irrespective of their mass-to-charge ratios.

It will be appreciated that the magnifying power of the lens or lenses making up the lens arrangement is configurable by adjusting the lens biasing, in particular by adjusting the voltage applied to the lenses by their voltage source or sources. For example, this means that the above-mentioned minimum and maximum threshold values can be adjusted in use, as well as the overall mass-to-charge sensitivity and range of the detector.

A further aspect of the invention provides a method of mass spectrometry, the method comprising: generating an ion beam comprising a plurality of ions, each having a mass-to-charge ratio; accelerating groups of the ions in a mass filter to nominally equal velocities irrespective of their mass-to-charge ratios, thereby to form ion packets; ejecting the ion packets from the mass filter along a beam axis; deflecting ions away from the beam axis by a distance from the beam axis that is inversely proportional to their mass-to-charge ratios; and detecting the mass-to-charge ratios of the ions according to their distances from the beam axis.

The amount of deflection of the ions is preferably adjusted so that a desired range of mass-to-charge ratios is detected. The amount of deflection of the ions may be adjusted a plurality of times, so that a plurality of desired ranges of mass-to-charge ratios are detected in a single measurement cycle. The ranges may be non-overlapping, but preferably the first range is relatively broad and second and subsequent ranges are sub-ranges of the first range selected interactively responsive to the results obtained from the first range.

BRIEF DESCRIPTION OF THE DRAWINGS

For a better understanding of the invention and to show how the same may be carried into effect reference is now made by way of example to the accompanying drawings in which.

DETAILED DESCRIPTION

Figure 3:
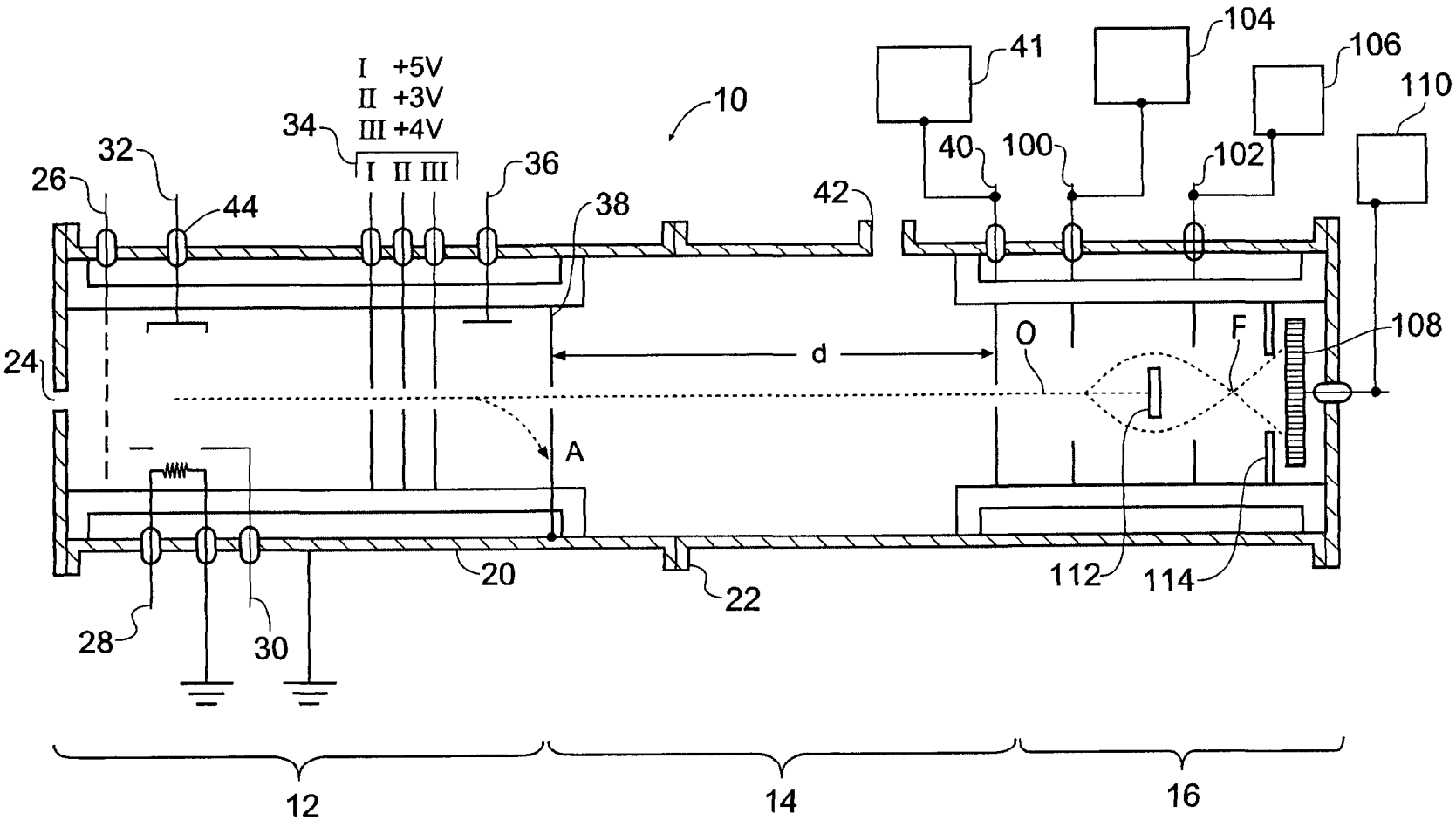
FIG. 3 is a schematic cross-sectional view of an embodiment of a mass spectrometer according to an embodiment of the invention.

FIG. 3 shows a schematic cross-sectional view of a mass spectrometer according to the present invention. The mass spectrometer will be described in terms of spectrometry of a gas, but the invention is equally applicable to non-gaseous analytes.

A mass spectrometer 10 has a body 20 formed primarily from stainless steel sections which are joined together by flange joints 22 sealed by O-rings (not shown). The body 20 is elongate and hollow. A gas inlet 24 is provided at one end of the body 20. A first ion repeller electrode 26 having a mesh construction is provided across the interior of the body 20, downstream of the gas inlet 24. The mesh construction is highly permeable to gas introduced through the gas inlet 24, but acts to repel ions when an appropriate voltage is applied to it.

An ioniser comprising an electron source filament 28, an electron beam current control electrode 30 and an electron collector 32 is located downstream of the first ion repeller electrode 26. The electron source filament 28 and the current control electrode 30 are located on one side of the interior of the body 20, and the electron collector 32 is located opposite them on the other side of the interior of the body 20. The features operate in the conventional fashion, in that, by the application of appropriate currents and voltages, electrons are generated by the source filament 28, collimated by the control electrode 30, and travel in a stream across the body 20 to the collector 32.

An ion collimator in the form of an Einzel lens 34 is located downstream of the ioniser. Einzel lenses are known in the art for collimating beams of ions [2]. Downstream of the lens 34 is a second ion repeller electrode 36, which is located on one side of the body 20 only, and an ion collector electrode 38 which is annular and extends across the body 20 and has an aperture for the passage of ions. The ion collector electrode 38 and the body 10 are both grounded.

The above-mentioned features can be considered together to comprise an ion source 12 which provides ions in a form suitable for being accelerated according to their mass-to-charge ratio.

Situated downstream of the collector electrode 38 is a mass filter 14 comprising an electrode arrangement. The mass filter 14 extends for a length d, between the ion collector electrode 38 and an exponential pulse electrode 40. The exponential pulse electrode 40 is annular and has an aperture for the passage for ions. A drive circuit 41 is provided for applying time varying voltage profiles to the exponential pulse electrode 40.

An outlet 42 is provided in the part of the body 10 which defines the outer wall of the mass filter. The outlet 42 permits connection of a vacuum system by means of which the pressure in the interior of the mass spectrometer 10 can be reduced to the required operating pressure, typically no higher than $1.3\times10^{-3}$ Pa ($\sim10^{-5}$ torr), which is usual for a mass spectrometer. The outlet 42 may alternatively be situated at the end of the body 20, near the gas inlet 24.

The term "exponential box" is used in the following to refer to the mass filter 14. More specifically, the dimensions of the exponential box 14 can be defined by the length d between the ion collector electrode 38 and the exponential pulse electrode 40 and the area enclosed by these electrodes.

Downstream of the exponential pulse electrode 40 an ion detector 16 is provided. The ion detector comprises first and second electrodes 100, 102. The first and second electrodes individually act as lenses and collectively form a lens combination for the ions, wherein the first and second electrodes are arranged such that the principal axis of the instrument is coincident with the "optical" axis O of the lenses where the term optical axis is used for convenience, since it is a term of art, even though of course there is no light in the present case. The first electrode 100 acts as a diverging or concave lens, serving to diverge the incident ions of the circular cross-section collimated ion beam away from the optical axis O. The second electrode 102 acts as a converging or convex lens of sufficient power to converge the diverging ions emitted from the first electrode 100 so that they come to a focal point F, subsequent to which they diverge again before striking an detector array 108.

A beam stop 112 is arranged in the line of the principal beam path or optical axis downstream of the divergent first electrode 100 and is positioned and dimensioned such that it blocks out particles that are insensitive to the action of the divergent first electrode lens 100 and thus continue along the main beam path unaffected, but does not block out ions having mass/charge ratios of interest, these having been diverted beyond the periphery of the beam stop 112. The beam stop will thus filter out particles such as photons and non-ionised atoms and molecules.

Following basic optical theory, according to which any combination of lenses is equivalent to a single lens, it will be appreciated that more than two electrodes could be used to provide the same effect, for example 3 or 4 lenses. For the same reason a single electrode could also be used. However, use of a single electrode is generally not preferred, since it does not allow for the convenient provision of the beam stop 112.

The two electrodes 100, 102 are annular with an aperture that allows the passage of ions. First and second voltage sources 104, 106 are provided for the first and second electrodes 100 and 102 respectively. Each voltage source 104, 106 serves to apply a desired voltage to its electrodes 100, 102. During an individual measurement, the voltage applied to each electrode should be maintained constant. An individual measurement may be of a single ion packet, but more likely will be performed over an accumulation of a series of ion packets.

It will be appreciated that the voltage applied to each electrode lens 100, 102 defines the magnifying power of the lens. In turn the magnifying power of the two lenses as well as the distance from the lens combination to the detector plate 108 determine the area, or "footprint", of the ions over the detector array. The range of mass-to-charge ratios collected by the detector array can thus be varied by suitable adjustment of either the lens voltages and/or, less conveniently, the position of the detector relative to the lenses. The beam stop could also be used to block heavier, lower charge ions (higher mass/charge ratio ions) which in combination with the fact that lighter, more highly charged ions miss the detector array entirely, allows the instrument to detect only a desired range of mass-to-charge ratios. This effect can be produced by moving the beam stop along the optical axis relative to the first lens 100 or by varying the diameter of the beam stop.

To harness this effect fully a beam mask 114 with a circular aperture can be provided, for example in advance of the detector array, to block out ions below a threshold m/z ratio. The beam mask 114 may be positioned immediately in front of the detector array, as illustrated, or at some other position in the lens combination. An alternative position would be coplanar with the beam stop 112, or indeed anywhere between where the concave lens initially diverges the ions and the detector. Provision of the beam mask 114 may also be useful for the practical consideration of wishing to avoid processing complications which may arise when ions fall on the extremities of the detector array, as a result of a typical detector array being square or rectangular, rather than circular.

These adjustment features will allow the instrument to be configured differently for different targets. At one extreme, isotope detection would require a high magnification over a small range of mass-to-charge ratio, whereas at the other extreme a low magnification would be needed if an extensive sweep covering a variety of commonly occurring ions were required. It could also be envisaged to collect multiple sets of data from the same sample with different magnifications and optionally jointly process the resulting data. In a further extension, the instrument could follow up a coarse sweeps of a large range of mass-to-charge ratios with one or more subsequent fine sweeps targeted at one or more particular ranges of mass-to-charge ratios identified by the coarse sweep.

The array detector 108 is in this example a microchannel plate. The microchannel array detector 108 is a single layer two-dimensional detector. Other position-sensitive detectors could be used. A read out means 110 is provided for reading out the position of the ion impact on the array detector 108.

The electrodes 26, 32, 34, 36, 40, 100, 102 are mounted on electrode supports 44 which are fabricated from suitable insulator materials such as a ceramic material or high density polyethylene (HDPE).

Operation of the mass spectrometer 10 will now be described.

Gas which is to be analysed is admitted into the interior of the mass spectrometer 10 at low pressure via the gas inlet 24. No means of gas pressure reduction is shown in the figures, but there are many known techniques available, such as the use of membranes, capillary leaks, needle valves, etc. The gas passes through the mesh of the first ion repeller electrode 26.

The gas is then ionised by the stream of electrons from the electron source filament 28, to produce a beam of positive ions. The electrons are collected at the electron collector 32, which is an electrode set at a positive voltage with respect to the current control electrode 30, to give electrons near the axis of the ion source, shown by the dotted line in FIG. 2, an energy of about 70 eV. This is generally regarded as being about the optimum energy for electron impact ionisation, as most molecules can be ionised at this energy, but it is not so great as to produce undesirable levels of fragmentation. The precise voltage applied to the electron collector 32 would normally be set by experiment but will probably be of the order of 140 V. It should be appreciated that there are many possible designs of electron impact ionisation source and, indeed, other methods of causing ionisation. The method and construction described herein and illustrated in the accompanying drawings is merely a preferred embodiment.

Any gas which is not ionised by the stream of electrons will pass through the mass spectrometer 10 and be pumped away by the vacuum system connected to the outlet 42. A flanged connection is suitable.

The dotted line referred to above also indicates the passage of ions through the mass spectrometer 10 which follows the primary axis of the instrument which is at least approximately coincident with the principal axis of cylindrical symmetry of the instrument's main body 20.

Figure 2:
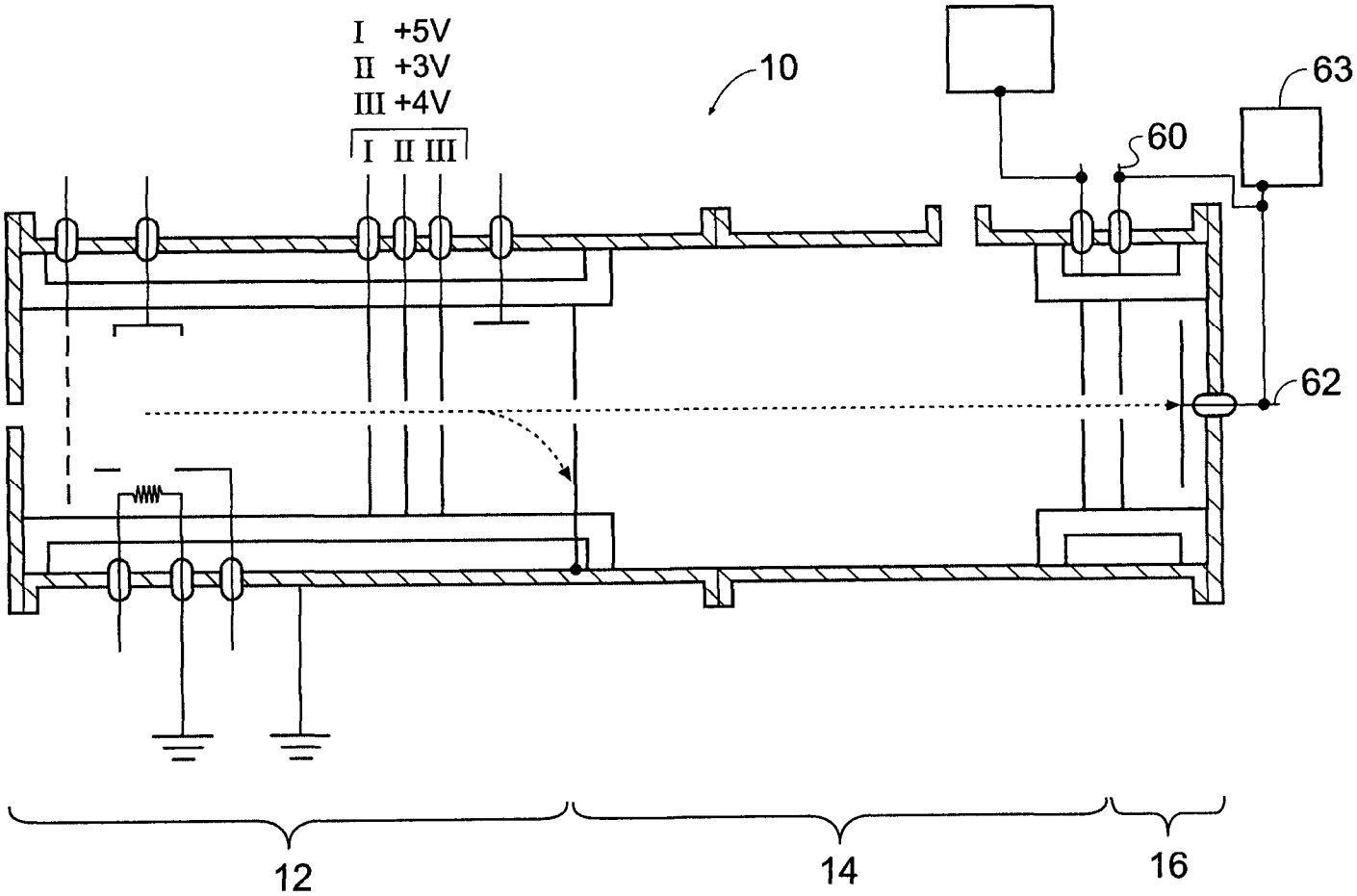
FIG. 2 (Prior Art)
FIG. 2 is a schematic cross-sectional view of a mass spectrometer according to the prior art, having an alternative ion detector to that shown in FIG. 1.

A positive voltage is applied to the first ion repeller electrode 26, to repel the (positive) ions and direct them through the Einzel lens 34 so as to produce a narrow, parallel ion beam. A positive voltage is applied to the second ion repeller electrode 36, so that the ion beam is deflected by the second ion repeller electrode 36. The deflected ions, which follow the dotted path labelled 'A' in FIG. 2, are collected at the ion collector electrode 38, which is grounded to prevent build-up of space charge.

To allow ions to enter the mass filter, the voltage on the second ion repeller electrode 36 is periodically set to 0 V to allow a small packet of ions to be undeflected so that they enter the exponential box 14 through the aperture in the ion collector electrode 38. In this way, the second ion repeller electrode 36 and the ion collector electrode 38 form a pulse generator for generating packets of ions.

At the moment at which the ion pulse enters the exponential box 14, an exponential voltage is applied to the exponential pulse electrode 40 by the drive circuit 41. The exponential pulse is of the form $V_t=V_0 \exp(t/\tau)$ with respect to time t where $\tau$ is the time constant. The maximum voltage is designated as $V_{max}$. (Since the ions are, in this case, positively charged, the exponential pulse will be negative going. It would need to be positive going in the case of negatively charged ions). The effect on the ions of the exponentially increasing electric field resulting from the voltage pulse is to accelerate them at an increasing rate towards the exponential pulse electrode 40. Ions with the smallest mass have the lowest inertia and will be accelerated more rapidly, as will ions bearing the largest charges, so that ions with the lowest m/z ratios will experience the largest accelerations. Conversely, ions with the largest m/z ratios will experience the smallest accelerations. After t seconds all of the ions have travelled the distance d and passed the exponential pulse electrode 40, at which point the exponential voltage pulse ceases. Also, after time t seconds, all of the ions are travelling with the same velocity $v_t$ mm $s^{-1}$, where $v_t=d/\tau$, but they are spatially separated. This is a particular consequence of an exponentially increasing voltage pulse, whereby if the electrode spacing d and the shaping and timing of the voltage pulse are correctly chosen, the velocity of all the ions is the same as they leave the exponential box, regardless of the mass of the ions. The mathematical derivation of this is given in the appendix to U.S. Pat. No. 7,247,847.

A perfect exponential box will accelerate all ions to an equal velocity. In practice, the ions will typically have a range of velocities, arising from any imperfections in the system. A spread of velocities of the order of 1% can typically be expected to be achieved, which has a negligible detrimental effect on the final results from the spectrometer. Indeed, meaningful results can be obtained for larger velocity spreads than this, up to spreads of about 10%, for example up to spreads of 2%, 3%, 4%, 5%, 6%, 7%, 8%, 9% or 10%.

Typically, the distance d can be of the order of a few centimeters. For example, if d is chosen to be 3 cm, and the highest m/z ratio ions present have an m/z of 100 Th, then an exponential pulse with a time constant $\tau$ of 0.77 μs needs to be applied for 3.8 μs to allow those ions to travel the distance d. This gives a peak voltage at the end of the pulse of −2 kV.

The precise values of the voltages which need to be applied to the various electrodes depends on the exact geometry adopted in the mass spectrometer 10. An example of a set of suitable voltages is as follows:

| | | |
|---|---|---|
| Ion repeller electrode | | +10 V |
| Electron collector | | +140 V |
| Einzel lens | I | +5 V |
| | II | +3 V |
| | III | +4 V |
| Ion repeller electrode | | +60 V |

Once the ions have left the exponential box, they must be detected according to their m/z ratio, so that the mass spectrum can be derived.

The ion detector 16 shown in FIG. 3 operates as follows:

A first desired voltage is applied to the first electrode 100 using the voltage source 104. The polarity of the applied voltage is such that it is negative with respect to the ions passing through the aperture in the first electrode 100. This causes the ions moving through the aperture of the electrode 100 to be deflected radially outwards with respect to the optical axis. As show in FIG. 3 by the dotted line, the ions will diverge away from the optical axis.

Simultaneously, a second desired voltage is applied to the second electrode 102 using the voltage source 106. The polarity of the applied voltage is such that it is the positive with respect to the ions passing through the aperture in the second electrode 102. This causes the ions having moved through the first electrode 100 to be deflected radially inwards. As shown in FIG. 3 by the dotted line, the ions will converge radially toward the optical axis and at some point converge to a focal point F on the optical axis.

The beam stop 112 prevents particles which are not charged and thus unaffected by the electrode lenses 100 and 102 from reaching the microchannel array detector 108. Such particles include photons, for example in the ultraviolet energy range, non-ionised atoms or molecules (so-called energetic neutrals) and uncharged debris which may be present depending on the design of the sampling system.

Once the ions have passed through the aperture in the second electrode 102, they will continue to move along a convergent path, as shown in FIG. 3, at some point crossing at the focal point F, whereafter they diverge again until they fall on to the microchannel plate array detector 108. A microchannel plate is an ion multiplying device which gives a typical gain of $10^6$-$10^7$, i.e. a single ion can generate between $10^6$ and $10^7$ electrons which are collected as a current pulse.

The path of the ions FIG. 3 (dotted line) shows that the ions will cross over the axis at the focal point F after passing through the aperture in the second electrode 102. The position of the focus will depend on the voltage applied to the two electrodes 100, 102 and the distance between the electrodes 100, 102. Moreover, the size of the circular area over which the ions impinge on the detector will vary according to these parameters and the distance between the electrodes and the detector.

It is noted that the detector could also be placed upstream of the focal point in which case the ions would not reach a focus.

The microchannel plate array detector 108 in FIG. 3 is an array detector. The most energetic ions (i.e. the highest mass and lowest charge ions) are deflected the least amount by the two electrodes 100, 102 and so will end up toward the centre of the detector surface. Conversely the lightest ions with the highest charge state will be deflected the most toward or beyond the periphery of the detector surface.

It will be appreciated that the ions falling on to the microchannel plate array detector 108 will do so in a radial manner (i.e. a circular impact pattern with mass-to-charge ratio will be observed), since the annular aperture of the first and second electrodes will diverge and converge the ions with radial symmetry. Therefore, it is possible to map a series of radii on to the microchannel plate array. Thus, ions that impact the microchannel plate array at a specific distance from the origin, i.e. the point at which the optical axis coincides with the detector array, will have a specific m/z ratio. In other words, using polar coordinates (r, θ) with the origin as defined above, all channels at a common 'r' coordinate, or in practice range of 'r±δr', relate to the same m/z ratio, or m/z ratio range, and are to be summed during the signal processing.

There are several techniques that can be used to read-out the position of ion impact on the detector surface, as discussed by D P Langstaff [3]. These include discrete anode and coincidence arrays, charge division and optical imaging detectors.

It will also be understood that other two-dimensional position sensitive detectors may be used, for example detectors consisting of or comprising a charged coupled device (CCDs). In principle, one-dimensional detectors could also be used in this embodiment, with the detector arranged in a strip crossing the origin, as defined above, although this would result in the majority of the ions not being collected and thereby reduce sensitivity.

The mass range and resolution of the spectrometer can be controlled by manipulation of the fixed voltages applied to the electrodes 100, 102 using the voltage supplies 104, 106. Therefore, the ion detector arrangement 16, shown in FIG. 3, could be used to collect low or high resolution spectrum. This could be carried out by collecting a low resolution spectrum using one set of fixed voltages applied to the two electrodes 100, 102 and then adjusting the two fixed voltages to effectively zoom in on a selected narrow range at a higher resolution. It will be appreciated that the resolution will still be limited by the energy spread of the ion source and the fidelity of the exponential accelerating pulse, for example.

While a result can be obtained for a single ion packet with this ion detector 16, successive packets can be accumulated so as to improve the signal to noise ratio and, thereby, the sensitivity of the spectrometer. Alternatively this ion detector can be used to obtain time-resolved data.

If the arrangement shown in FIG. 3 is implemented it should be possible to collect most, if not all, of the ion species of interest that enter the detector 14, since a two dimensional array may be used to detect the ions. By using such a two dimensional array in combination with the two electrodes shown in FIG. 3, the mass of the ions can be detected by the specific radius at which they impact the microchannel plate array surface. Furthermore, if the optional beam stop 112 in the arrangement shown in FIG. 3 is included, the ions will still impact the microchannel detector array 108 and be detected, but the unwanted non-ions should be prevented from reaching the detector.

Figure 4:
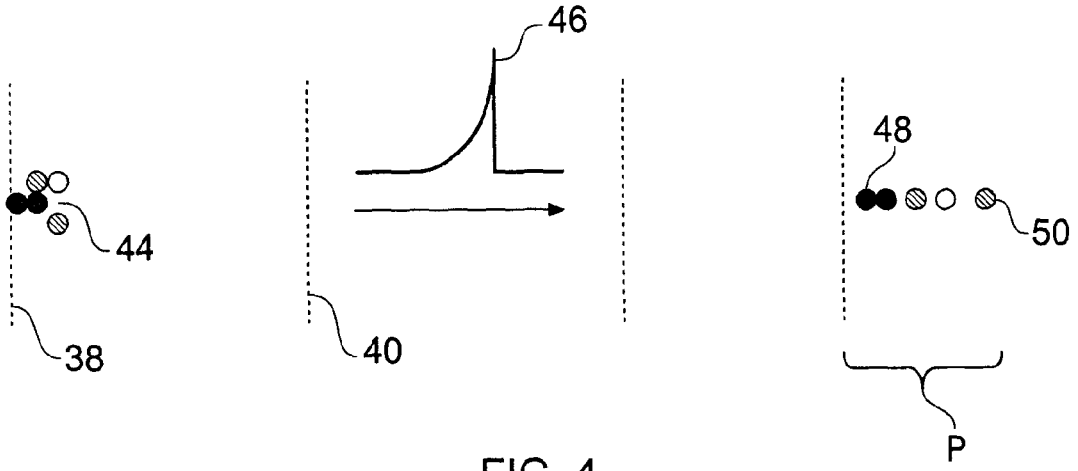
FIG. 4 is a schematic view of an ion packet in the mass spectrometer of FIG. 3.

FIG. 4 illustrates the principle of the exponential box 14 schematically. A packet of ions 44 enters the exponential box at the ion collector electrode 38, which has a zero applied voltage. The ions then travel to the exponential pulse electrode 40 to which the time varying voltage profile 46 is applied by the drive circuit 41. In this case the profile has the form $V_t=V_0 \exp(t/\tau)$ which is negative going since the ions are positive. After passing the exponential pulse electrode, the ions are spatially separated over a distance P, with the heaviest ion 48 (largest m/z ratio) at the rear and the lightest ion 50 (lowest m/z ratio) at the front. A fuller description is provided in U.S. Pat. No. 7,247,847.

Figure 5:
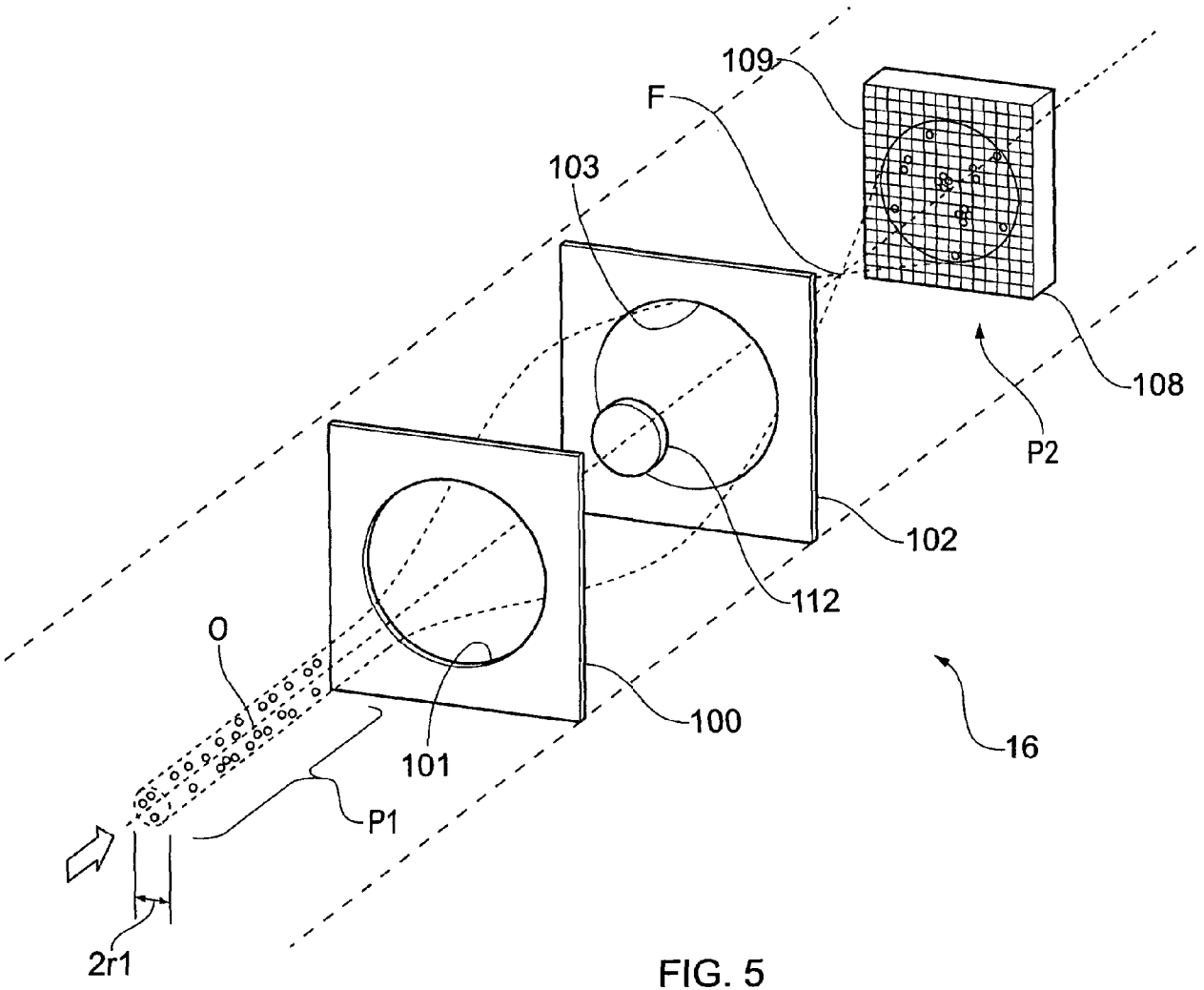
FIG. 5 is a schematic perspective view of the ion detector assembly of FIG. 3.

FIG. 5 is a schematic perspective view of the ion detector 16. The main parts are illustrated which, in order of the direction of travel of the ions, are the first electrode lens 100 with circular aperture 101, the beam stop 112 which is a circular disc, the second electrode lens with circular aperture 103 and the array detector 108 having sensor surface 109 comprising a two-dimensional area of sensing channels, each of which is illustrated as being square in the plane orthogonal to the optical axis or beam axis O. The drawing illustrates an ion packet P1 of finite length along the beam direction at time t1 immediately prior to entering the first electrode lens 100. A number of atomic and molecular ions are schematically shown which are generally distributed within a finite range of radial distances r1 from the optical axis O, the region having a circular cross-section relative to the optical axis O. The packet P1 thus fills a volume defined by a cylinder. Once the ions enter the region of influence of the first electrode lens 100, they radially diverge occupying a gradually increasing radial distance r from the optical axis O. When passing the beam stop 112 neutral particles that are not deflected by the electric field applied by the lens 100 are stopped, as well as any ions with sufficiently large mass/charge ratio that they have not been sufficiently deflected to avoid the beam stop. As described above, this effect may be utilized deliberately to filter out ion species having mass/charge ratios that are above a maximum value of interest for the measurement in hand. The ions of the ion packet then enter the region of influence of the second electrode lens 102 and are deflected radially inwardly towards the optical axis. The ions pass through the aperture 103 in the second electrode lens 102 and, at some point between the second electrode lens 102 and the detector array 108, pass through a focus F, after which the ions diverge again before impacting the sensor surface 109 of the detector array 108 at a time t2 and as illustrated with the reference numeral P2. As indicated schematically, the ion distribution is such that ions with lower mass/charge ratios are towards the periphery of the circular area of impact, and ions of higher mass/charge ratios are situated towards the centre of the circular area of impact. In other words, the radial distance from the point of intersection of the optical axis with the sensor surface, i.e. the detection origin, to the point of impact of a given ion is a measure of that ion's mass/charge ratio. Preferably there is a linear or near linear relation between this radial distance and the mass/charge ratio. However, any known relation is acceptable, since this can then be applied during the signal processing to assign a mass/charge ratio, or more accurately a range of mass/charge ratios based on the extent of the pixel and the relation between radial distance and mass/charge ratio, to each pixel, channel or cell of the sensor array, based on the distance of that pixel, channel or cell from the origin.

Figure 6:
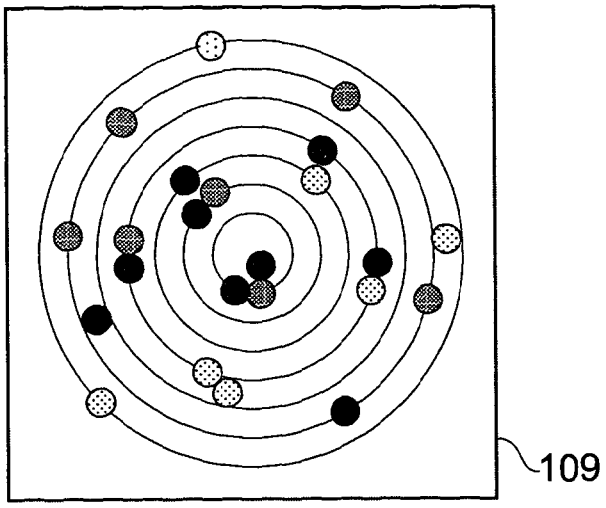
FIG. 6 is a schematic front elevation of ions collected over the sensor surface of the ion detector of FIG. 3.

FIG. 6 is a schematic front elevation of ions collected over the sensor surface 109 in which concentric rings are drawn to indicate mass/charge ratio values as well as example ions, where progressively darker shading is used to indicated heavier atom species, and single atoms, two-atom molecules and three-atom molecules are schematically depicted. No attempt is made in the schematic illustration to show the effect of charge state. The heavier ions are shown falling nearer the origin and the lighter ones farthest away from the origin.

Figure 7:
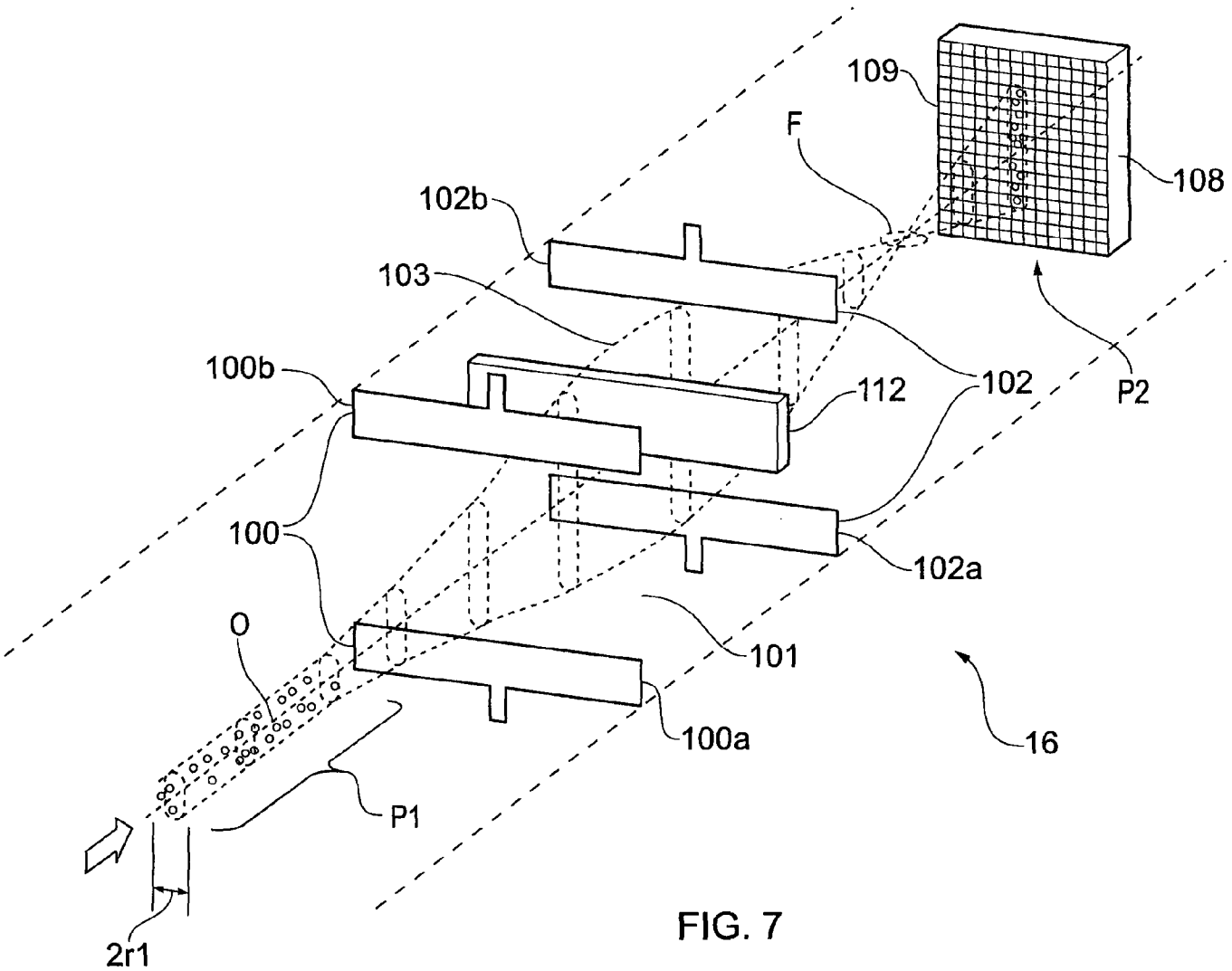
FIG. 7 is a schematic perspective view of the ion detector assembly of an alternative embodiment.

FIG. 7 is a schematic perspective view of the principal parts of the ion detector assembly 16 of an alternative embodiment. FIG. 3 also accurately depicts this alternative embodiment which differs from the arrangement of FIG. 5 only in respect of the symmetry of the ion detector. The same reference numerals are used to indicate corresponding features. With the arrangement shown in FIG. 5, the lenses are spherical lenses, resulting in the ion beam having a circular cross-section orthogonal to the optical axis at all points along the optical axis. The alternative embodiment of FIG. 7 is instead based on cylindrical lenses. Each of the first and second lens electrodes 100 and 102 are thus formed of electrode elements with straight sides or edges, instead of the circular apertures of the embodiment of FIG. 5. Electrode lens 100 is formed by a pair of co-planar opposed electrode elements 100*a* and 100*b* with parallel straight facing edges creating an aperture 101 therebetween. Each element 100*a*, 100*b* is shown having a generally rectangular shape, but the shape distal the beam path is largely arbitrary. An equivalent arrangement for the electrode lens 100 would be to form it from a single element, like the lenses of the embodiment of FIG. 5, but having an elongate rectangular aperture. The second electrode lens 102 has similar construction to the first electrode lens 100 comprising a pair of co-planar elements 102*a* and 102*b* forming an aperture 103. The electrode lenses thus act as cylindrical lenses, in contrast to the spherical lenses of the embodiment of FIG. 5. Further, the beam stop 112 in this embodiment has straight edges or sides running parallel to each other, and also parallel to the direction of extent of the facing inner edges of the first and second electrode lenses. Moreover, if a beam mask 114 is used (not shown) in this alternative embodiment, it would also have straight edges or sides running parallel to each other, and also parallel to the direction of extent of the facing inner edges of the first and second electrode lenses.

An ion packet P1 is shown prior to entrance into the first lens and has a circular cross-section of radius r1 and finite length along the beam axis, thus forming a cylinder. On entry to the first electrode lens 100, the ions are deflected uniaxially outwardly, vertically in the figure, in a one-dimensional stretch transformation, as opposed to the radial dilation of the embodiment of FIG. 5, wherein the axis of elongation is orthogonal to the direction of extent of the inner edges of the electrode lens. This is illustrated by showing an increasingly distended cross-section. After passing through the aperture 101 of the first lens 100, the ions continue to spread apart in the vertical direction of the figure and pass the beam stop 112 which traps unwanted neutral particles, and optionally some ions, as discussed in connection with the previous embodiment. The ions of the ion packet then come under the influence of the second electrode lens 102 and are urged uniaxially inwardly ultimately coming to a line focus F at some position along the optical axis F after passing through the aperture 103 of the second electrode lens and prior to impacting on the detector array 108. After passing through the line focus, the ions of the ion packet then diverge uniaxially again and fall on the sensor area 109 of the detector array 108 at a time t2, the ions being spread vertically either side of the origin according to their mass-to-charge ratios, as shown with reference numeral P2.

Figure 8:
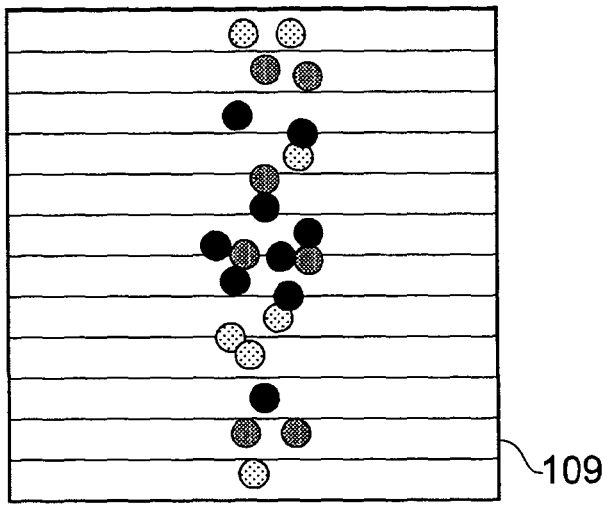
FIG. 8 is a schematic front elevation of ions collected over the sensor surface of the ion detector of the alternative embodiment of FIG. 7.

FIG. 8 is a schematic front elevation of ions collected over the sensor surface of the ion detector of the alternative embodiment. Horizontal lines are drawn to indicate mass/charge ratio values as well as example ions, where progressively darker shading is used to indicated heavier atom species, and single atoms, two-atom molecules and three-atom molecules are schematically depicted. No attempt is made in the schematic illustration to show the effect of charge state. The heavier ions, with three atoms, are shown falling nearer the origin and the lightest ones, with a single atom, farthest away from the origin. It will be appreciated that distance above or below the origin is indicative of the same mass-to-charge ratio. It will further be appreciated that with this embodiment a one-dimensional detector array would have the same functionality as a two-dimensional detector array. Use of a multi-channel photomultiplier tube or other one-dimensional detector array may therefore be considered.

Figure 9:
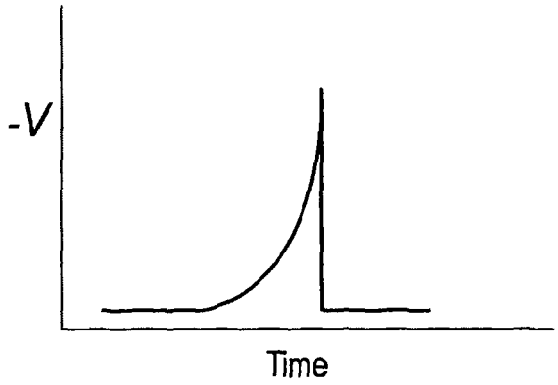
FIGS. 9, 10 and 11 show different functional forms of voltage pulse which may be used to effect the acceleration of all ions in an ion packet to equal velocities.
Figure 10:
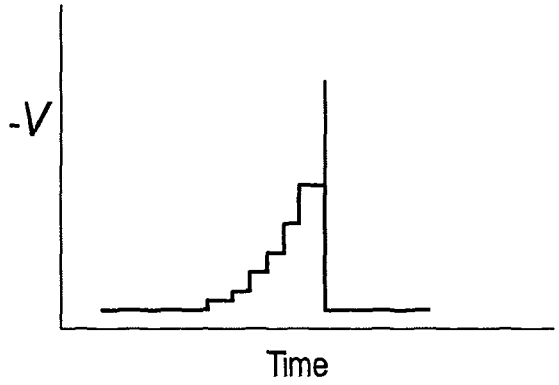
Figure 11:
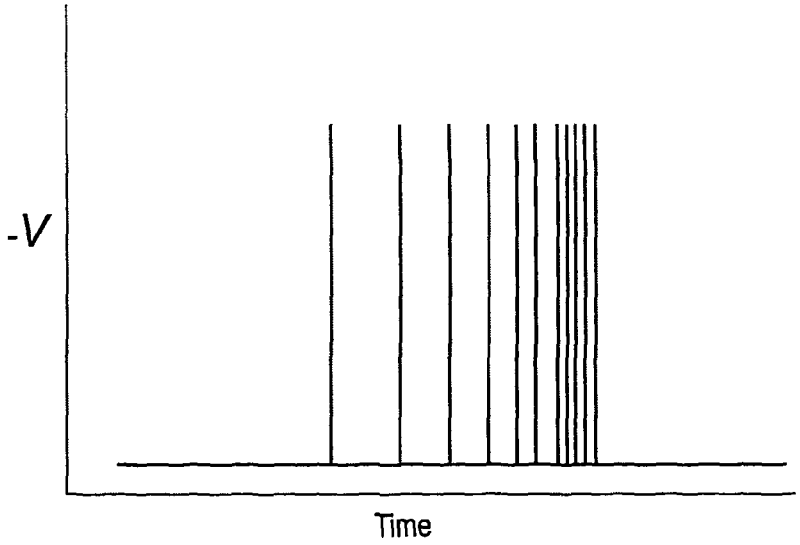
Figure 1:
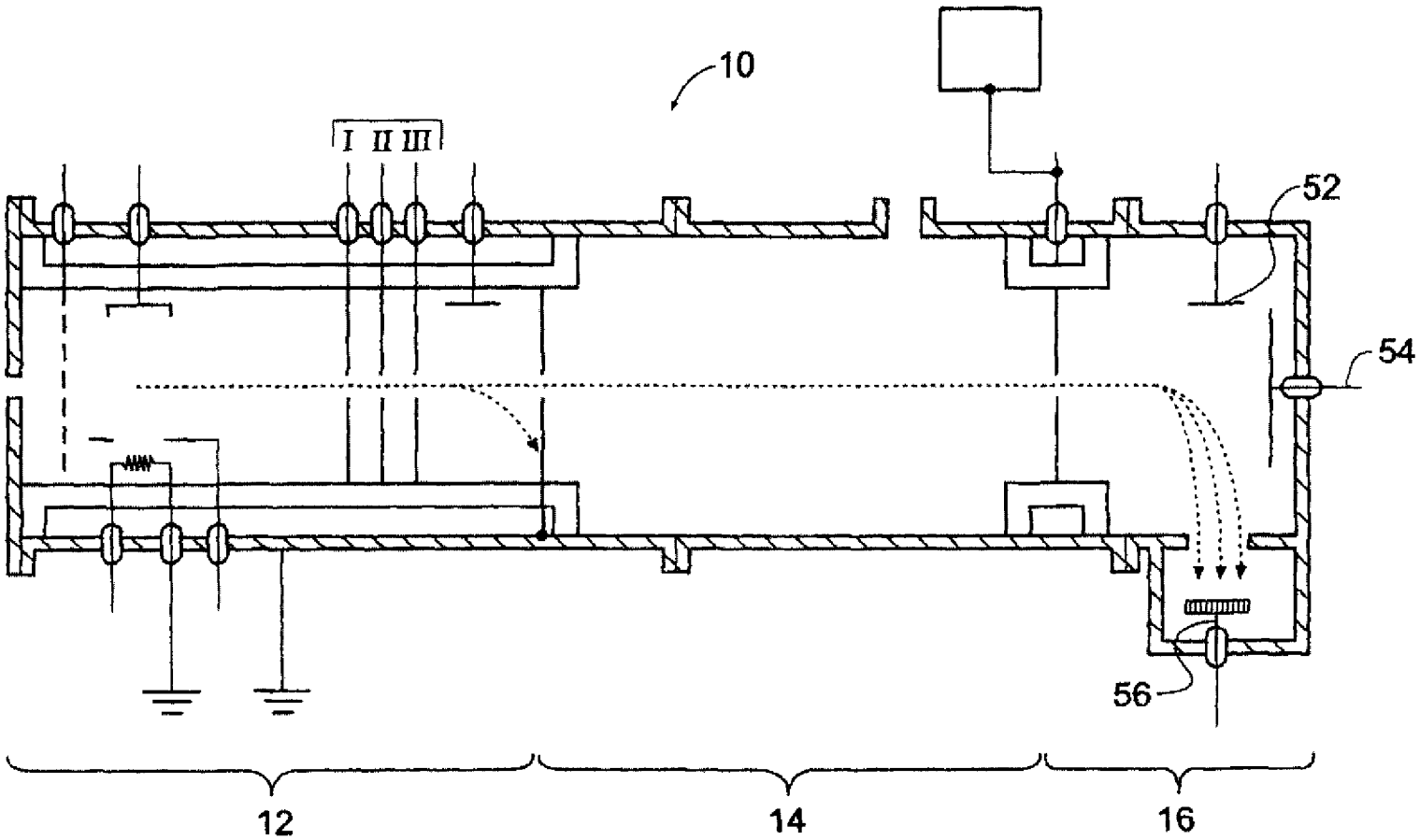
FIG. 1 (Prior Art)
Figure 2:
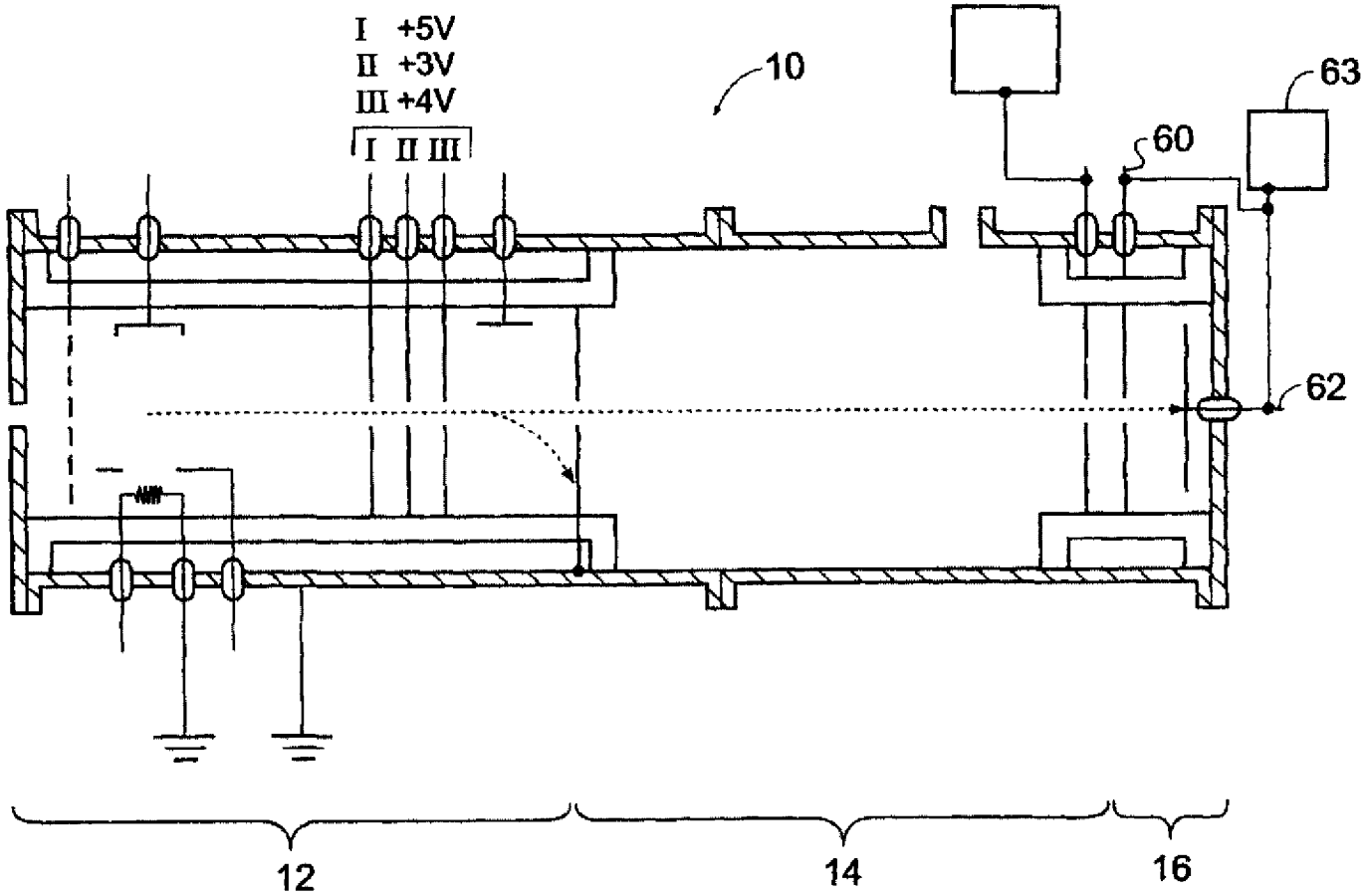
FIG. 2 (Prior Art)
Figure 3:
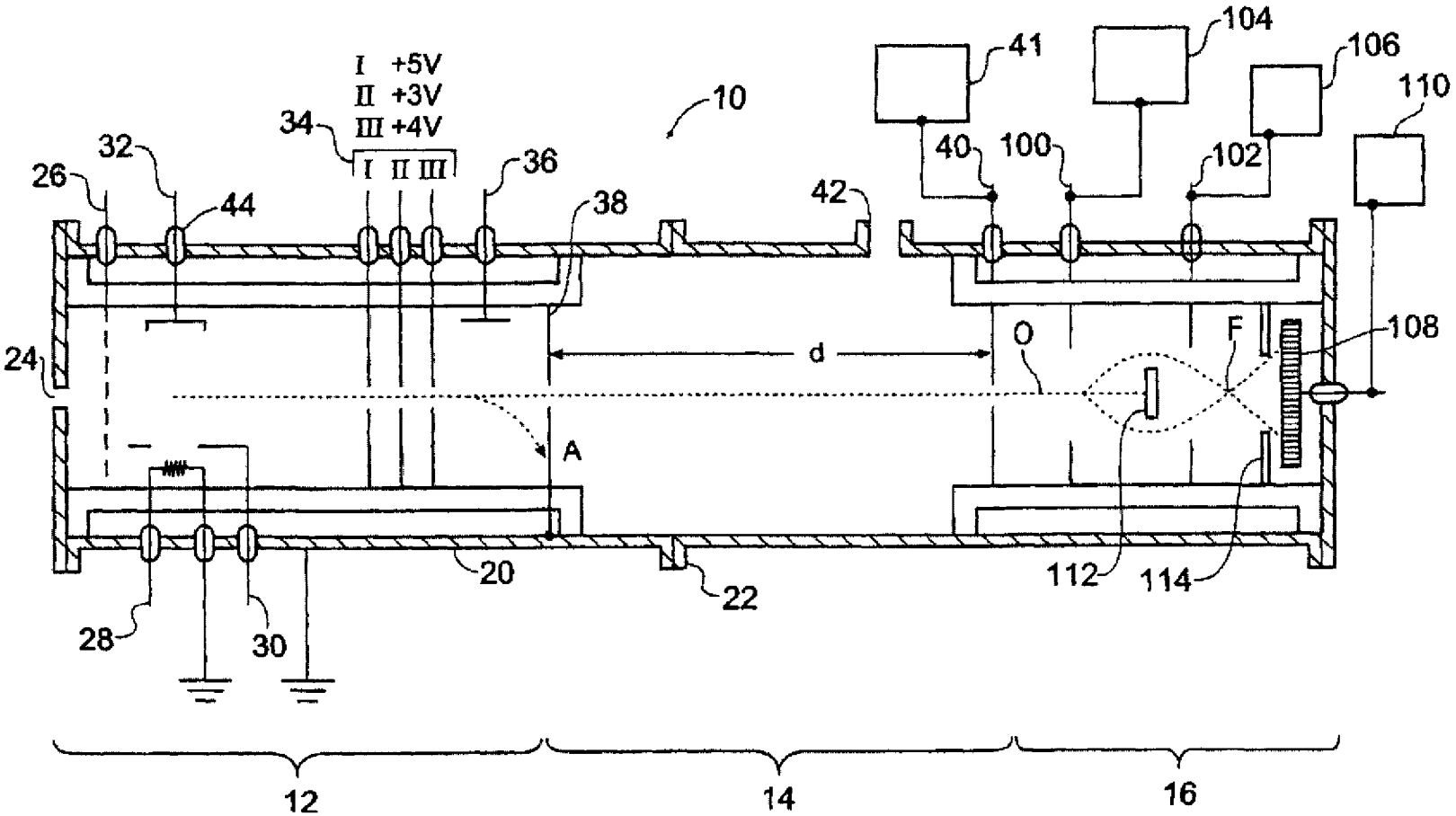
Figure 4:
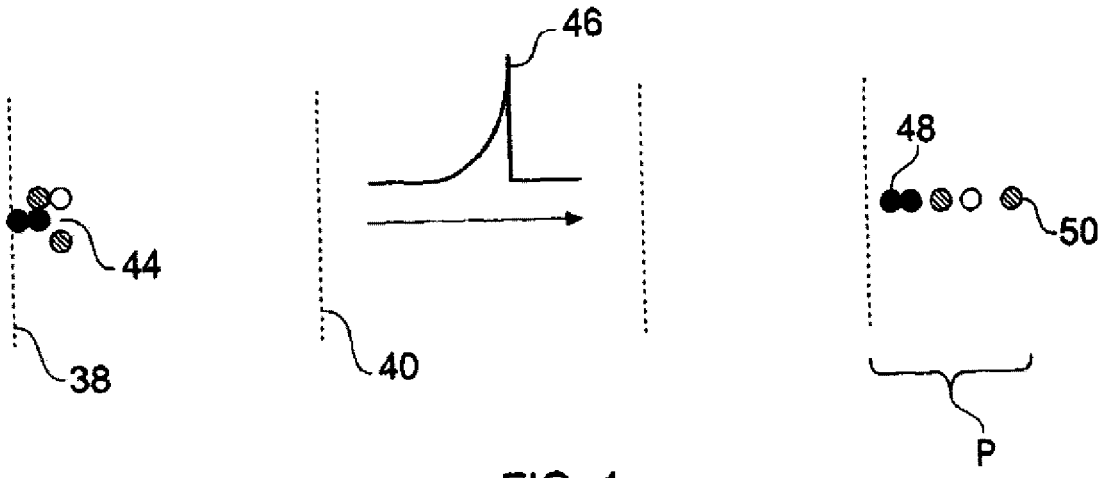
Figure 5:
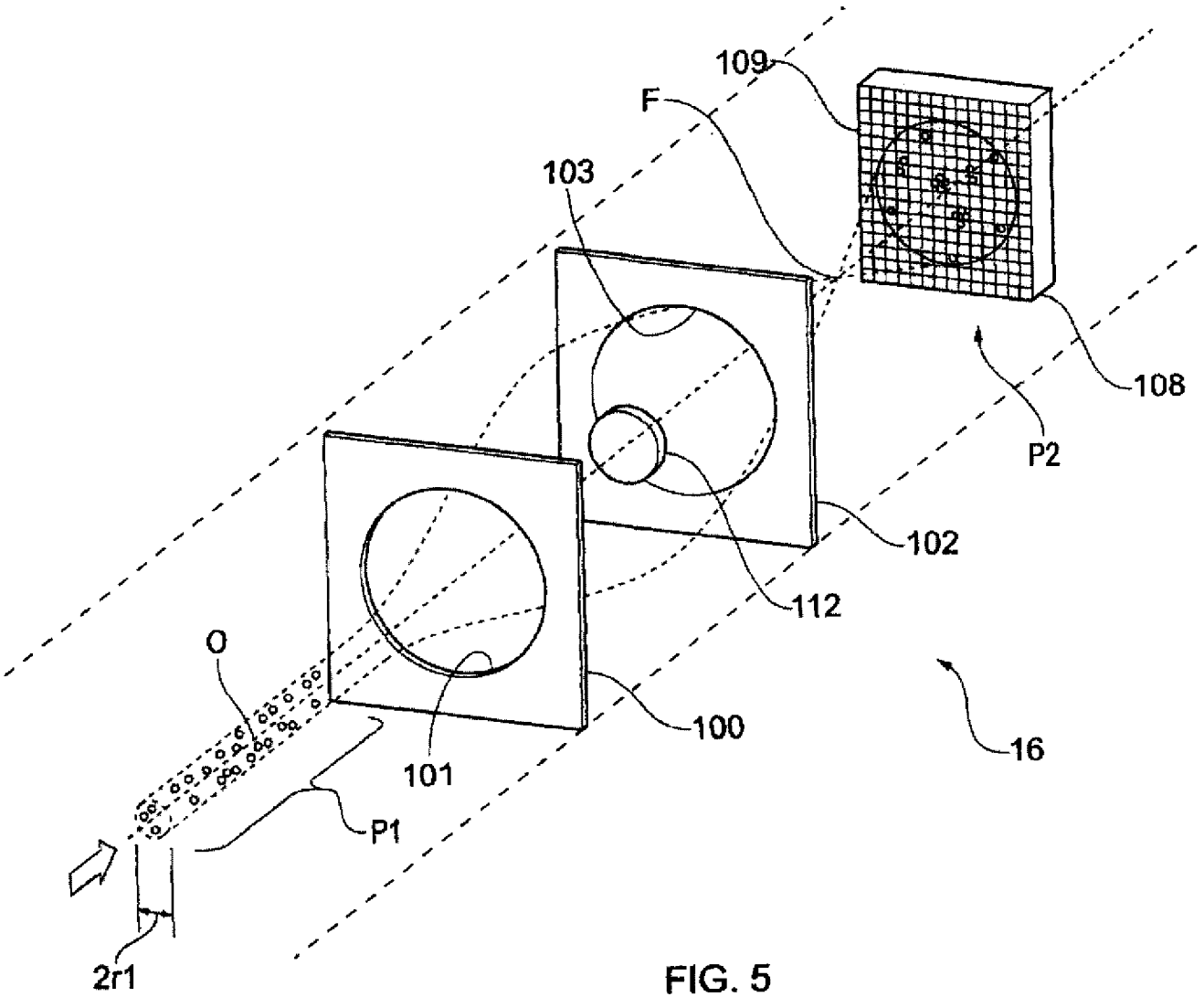
Figure 6:
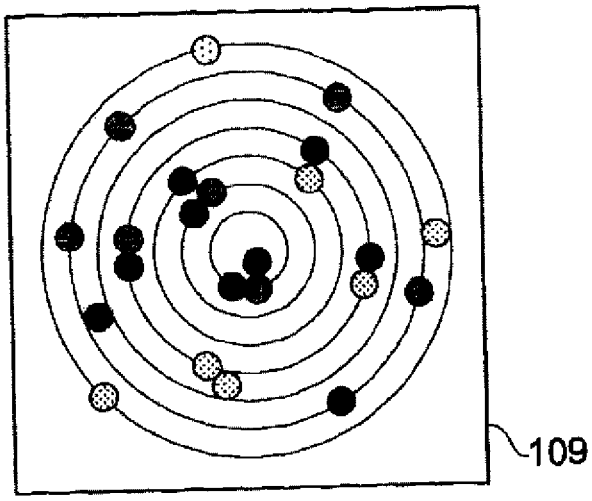
Figure 7:
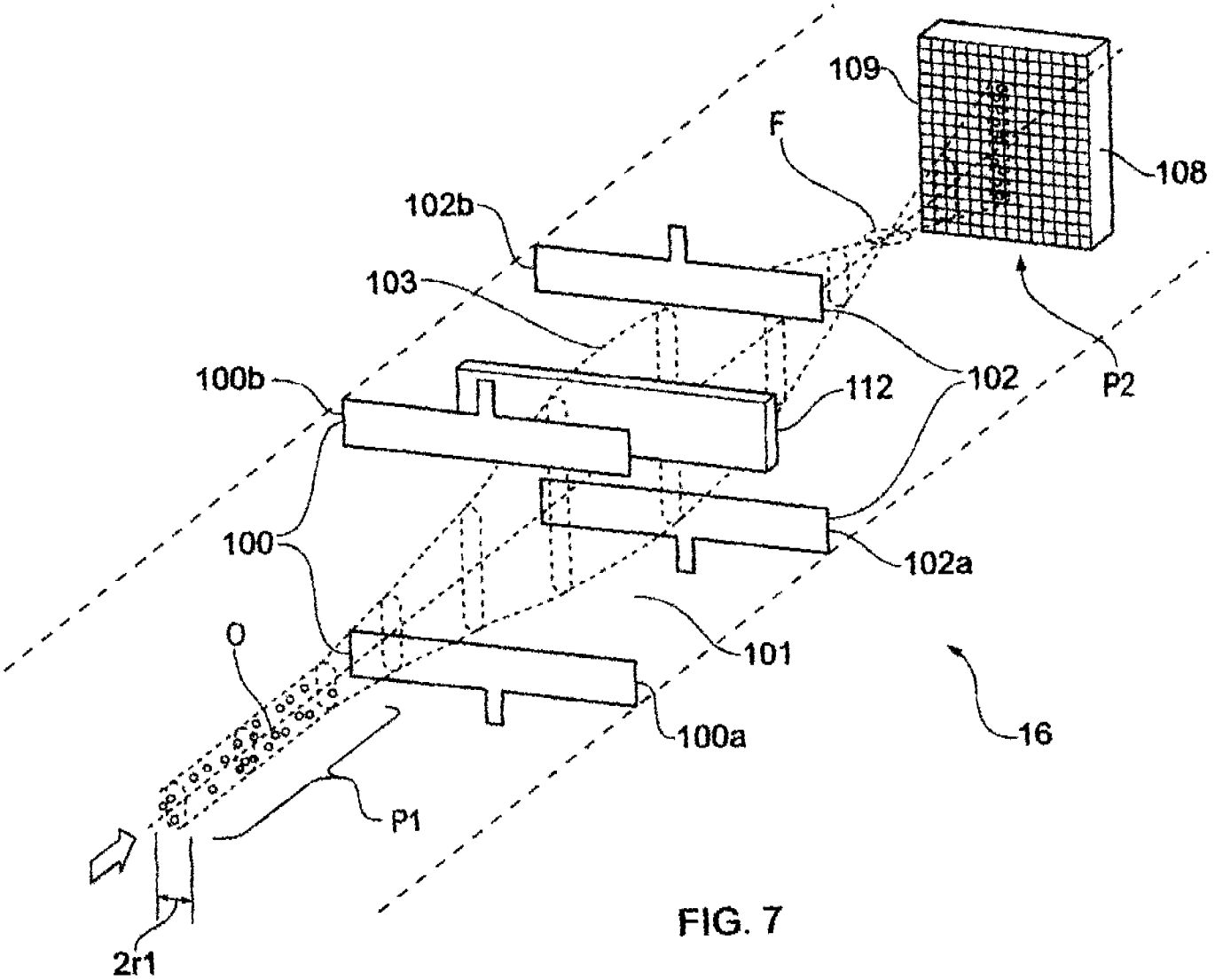
Figure 8:
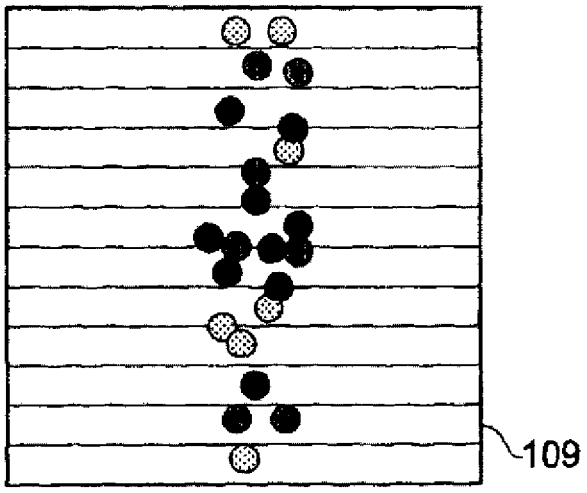
Figure 9:
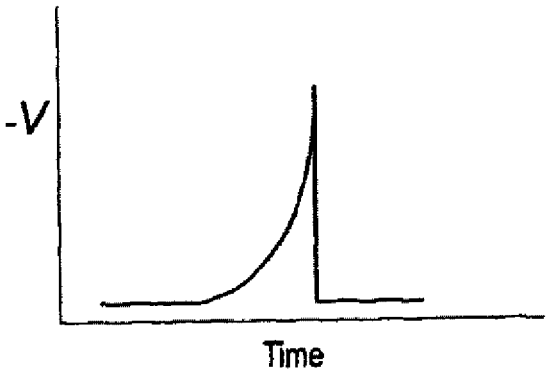
Figure 10:
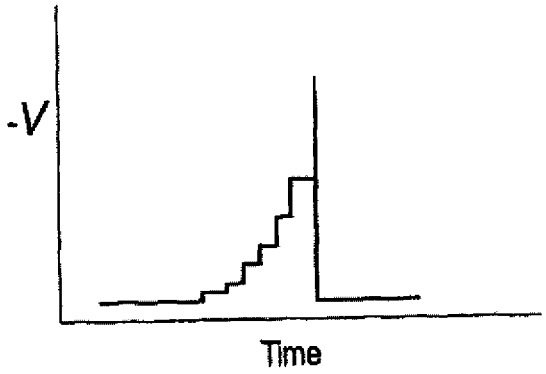
Figure 11:
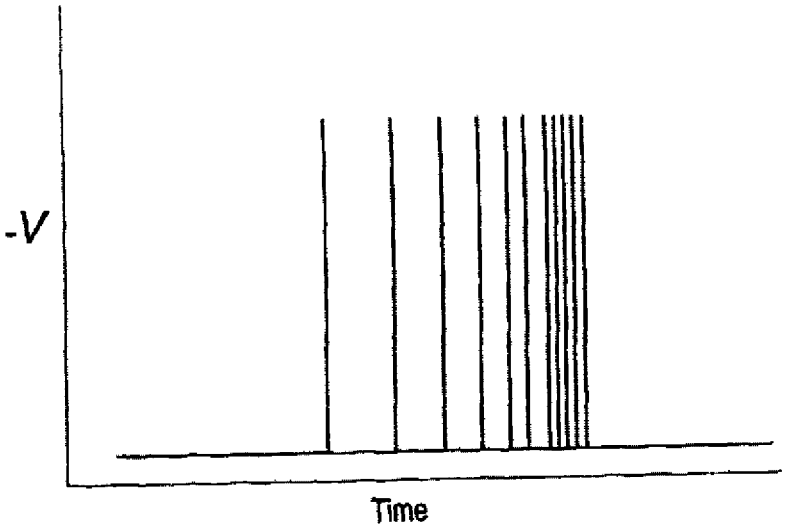

FIGS. 9, 10 and 11, which are reproduced from U.S. Pat. No. 7,247,847, illustrate different possible voltage profiles.

FIG. 9 shows an analogue exponential pulse, as a graph of voltage against time.

FIG. 10 shows a digitally synthesised exponential pulse, having the step features characteristic of digital signals.

FIG. 11 shows a frequency modulated pulse train of pulses of constant amplitude, short duration, and increasing repetition frequency.

The features and relative merits of these different voltage profiles are described in more detail in U.S. Pat. No. 7,247,847. A drive circuit suitable for the generation of analogue exponential pulses is also disclosed in U.S. Pat. No. 7,247,847 and can be used for the present design also. Indeed everything stated in U.S. Pat. No. 7,247,847 in relation to the drive circuit and possible variations in its design apply here also.

Furthermore, it will be appreciated that variations in design and uses described in U.S. Pat. No. 7,247,847, as well as design details omitted from the present document to avoid duplication with U.S. Pat. No. 7,247,847, apply equally to the present invention except in relation to the ion detector 16 by which the present design differs from the designs presented in U.S. Pat. No. 7,247,847. In particular, all statements made in U.S. Pat. No. 7,247,847 in relation to the ion source 12 and mass filter 14 apply equally to the present invention.

Everything described hereinabove concerns positive ion mass spectrometers. Negative ion mass spectrometry is less commonly employed but the principles of the present invention can equally well be applied to negative ions. In such a case, the polarities of the electric fields described herein would need to be reversed, including use of a positive going exponential pulse.

Further, while the design of the ion detector has been described in terms of an electrostatic lens arrangement in the above detailed description, it would be possible to provide an equivalent magnetic lens arrangement, so the invention applies more generally to an electromagnetic lens arrangement.

A mass spectrometer has thus been described which operates according to the iso-tach principle, i.e. the mass filter accelerates ions to nominally equal velocities irrespective of their mass-to-charge ratios. The mass spectrometer according to the embodiments of the invention is provided with a novel detector based on an electrostatic lens arrangement made of a concave lens followed in the beam path by a convex lens.

These lenses deflect ions away from the beam axis by a distance from the beam axis that is inversely proportional to their mass-to-charge ratios. The mass-to-charge ratio of the ions can then be determined by a suitable detector array, such as a multi-channel plate placed in the beam path. This provides a compact and sensitive instrument.

REFERENCES

[1] U.S. Pat. No. 7,247,847

[2] "Enhancement of ion transmission at low collision energies via modifications to the interface region of a 4-sector tandem mass-spectrometer", Yu W., Martin S. A., Journal of the American Society for Mass Spectroscopy, 5(5) 460-469 May 1994

[3] "An MCP based detector array with integrated electronics", D. P. Langstaff, International Journal of Mass Spectrometry volume 215, pages 1-12 (2002).

The invention claimed is:

1. A mass spectrometer comprising:

an ion source operable to provide an ion beam comprising a plurality of ions, each having a mass-to-charge ratio;

a mass filter arranged to receive the ion beam from the ion source and configured to eject ion packets in each of which the ions have nominally equal velocities irrespective of their mass-to-charge ratios, wherein the ion packets are ejected along a beam axis; and an ion detector arranged in the beam axis so as to receive the ion packets from the mass filter, wherein the ion detector comprises a lens arrangement operable to deflect ions away from the beam axis by a distance from the beam axis inversely proportional to their mass-to-charge ratios, and further comprises a position-sensitive sensor having a plurality of channels which lie at different distances away from the beam axis, so as to detect the mass-to-charge ratios of the ions according to their distances from the beam axis.

2. The mass spectrometer of claim 1, wherein the lens arrangement comprises first and second lenses.

3. The mass spectrometer of claim 2, wherein the first lens is a concave lens and the second lens is a convex lens.

4. The mass spectrometer of claim 3, wherein the concave lens is arranged to receive the ions before the convex lens.

5. The mass spectrometer of any of claims 1 to 4, wherein the lens arrangement is spherical, thereby separating out ions radially about the beam axis according to their mass-to-charge ratios.

6. The mass spectrometer of any of claims 1 to 4, wherein the lens arrangement is cylindrical, thereby separating out ions uni-axially about the beam axis according to their mass-to-charge ratios.

7. The mass spectrometer of any preceding claim, wherein a beam stop is arranged in the path of the deflected ions to filter out uncharged particles that have propagated along the beam axis unaffected by the lens arrangement.

8. The mass spectrometer of claim 7, wherein the beam stop is arranged and dimensioned to extend laterally from the beam axis so as to filter out ions having a mass-to-charge ratio above a maximum threshold value.

9. The mass spectrometer of any preceding claim, wherein a beam mask is arranged in the path of the deflected ions to filter out ions having a mass-to-charge ratio below a minimum threshold value.

10. A method of mass spectrometry, the method comprising:

generating an ion beam comprising a plurality of ions, each having a mass-to-charge ratio;

accelerating groups of the ions in a mass filter to nominally equal velocities irrespective of their mass-to-charge ratios, thereby to form ion packets, ejecting the ion packets from the mass filter along a beam axis;

deflecting ions away from the beam axis by a distance from the beam axis that is inversely proportional to their mass-to-charge ratios; and detecting the mass-to-charge ratios of the ions according to their distances from the beam axis.

11. The method of claim 10, wherein the amount of deflection of the ions is adjusted so that a desired range of mass-to-charge ratios is detected.

12. The method of claim 11, wherein the amount of deflection of the ions is adjusted a plurality of times so that a plurality of desired ranges of mass-to-charge ratios are detected in a single measurement cycle.

* * * * *

UNITED STATES PATENT AND TRADEMARK OFFICE

CERTIFICATE OF CORRECTION

PATENT NO. : 8,692,188 B2
APPLICATION NO. : 13/580503
DATED : April 8, 2014
INVENTOR(S) : Webb It is certified that error appears in the above-identified patent and that said Letters Patent is hereby corrected as shown below:

Please delete patent 8692188 in its entirety and insert patent 8692188 in its entirety as shown on the attached pages.

Signed and Sealed this
Sixteenth Day of June, 2015

Michelle K. Lee

Michelle K. Lee
*Director of the United States Patent and Trademark Office*

(12) United States Patent
Webb

(10) Patent No.: US 8,692,188 B2
(45) Date of Patent: Apr. 8, 2014

(54) MASS SPECTROMETERS AND METHODS OF ION SEPARATION AND DETECTION

(75) Inventor: Brian Christopher Webb, Wiltshire (GB)

(73) Assignee: Ilika Technologies Limited, Hampshire (GB)

( * ) Notice: Subject to any disclaimer, the term of this patent is extended or adjusted under 35 U.S.C. 154(b) by 36 days.

(21) Appl. No.: 13/580,503

(22) PCT Filed: Nov. 10, 2010

(86) PCT No.: PCT/GB2010/002063
§ 371 (c)(1),
(2), (4) Date: Aug. 22, 2012

(87) PCT Pub. No.: WO2011/101607
PCT Pub. Date: Aug. 25, 2011

(65) Prior Publication Data

US 2012/0312982 A1 Dec. 13, 2012

(30) Foreign Application Priority Data

Feb. 22, 2010 (GB) ..... 1002967.6

(51) Int. Cl.
*H01J 49/26* (2006.01)

(52) U.S. Cl.
CPC ..... *H01J 49/26* (2013.01)
USPC ..... 250/282; 250/288; 250/293

(58) Field of Classification Search
USPC ..... 250/282
See application file for complete search history.

(56) References Cited

U.S. PATENT DOCUMENTS

| | | | | |
|---|---|---|---|---|
| 5,726,448 | A | 3/1998 | Smith | |
| 6,521,887 | B1 * | 2/2003 | Funsten et al. | 250/287 |
| 7,247,847 | B2 * | 7/2007 | Webb et al. | 250/293 |
| 2006/0138318 | A1 * | 6/2006 | Enke | 250/287 |
| 2009/0101813 | A1 | 4/2009 | Holle | |

FOREIGN PATENT DOCUMENTS

| | | |
|---|---|---|
| GB | 2219688 | 12/1989 |
| GB | 2376562 | 12/2002 |

OTHER PUBLICATIONS

UK Search Report for corresponding patent application No. GB1002967.6 dated Jun. 7, 2010.
International Search Report for corresponding patent application No. PCT/GB2010/002063 dated Feb. 15, 2011.

* cited by examiner

*Primary Examiner* — Phillip A. Johnston
(74) *Attorney, Agent, or Firm* — Renner, Otto, Boisselle & Sklar, LLP

(57) ABSTRACT

A mass spectrometer operating according to the iso-tach principle in which a mass filter accelerates ions to nominally equal velocities irrespective of their mass-to-charge ratios. The mass spectrometer is provided with an improved detector based on an electrostatic lens arrangement made of a concave lens followed in the beam path by a convex lens. These lenses deflect ions away from the beam axis by a distance from the beam axis that is inversely proportional to their mass-to-charge ratios. The mass-to-charge ratio of the ions can then be determined by a suitable detector array, such as a multi-channel plate placed in the beam path. This provides a compact and sensitive instrument.

11 Claims, 9 Drawing Sheets

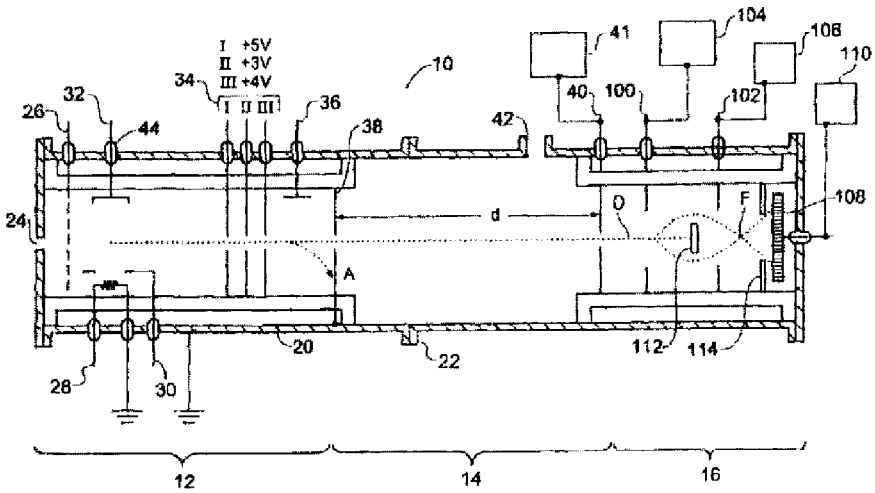

MASS SPECTROMETERS AND METHODS OF ION SEPARATION AND DETECTION

This application is a national phase of International Application No. PCT/GB2010/002063 filed Nov. 10, 2010 and published in the English language.

BACKGROUND OF THE INVENTION

The invention relates to mass spectrometers and also to methods of ion separation and ion detection for use with mass spectrometers.

A mass spectrometer is capable of ionising a neutral analyte molecule to form a charged parent ion that may then fragment to produce a range of smaller ions. The resulting ions are collected sequentially at progressively higher mass/charge (m/z) ratios to yield a so-called mass spectrum that can be used to "fingerprint" the original molecule as well as providing much other information. In general, mass spectrometers offer high sensitivity, low detection limits and a wide diversity of applications.

There are a number of conventional configurations of mass spectrometers including magnetic sector type, quadrupole type and time of flight type. More recently, one of the present inventors has developed a new type of mass spectrometer that operates according to a different basic principle, as described in U.S. Pat. No. 7,247,847 [1], the full contents of which are incorporated herein by reference. The mass spectrometer of U.S. Pat. No. 7,247,847 accelerates all ion species to nominally equal velocities irrespective of their mass-to-charge ratios to provide a so-called constant velocity or iso-tach mass spectrometer. This is in contrast to time-of-flight mass spectrometers which aim to impart the same kinetic energy to all ion species irrespective of mass.

U.S. Pat. No. 7,247,847 discloses two principal embodiments which differ in respect of their detector designs. These two prior art designs are reproduced in FIGS. 1 and 2 of the accompanying drawings.

Figure 1:
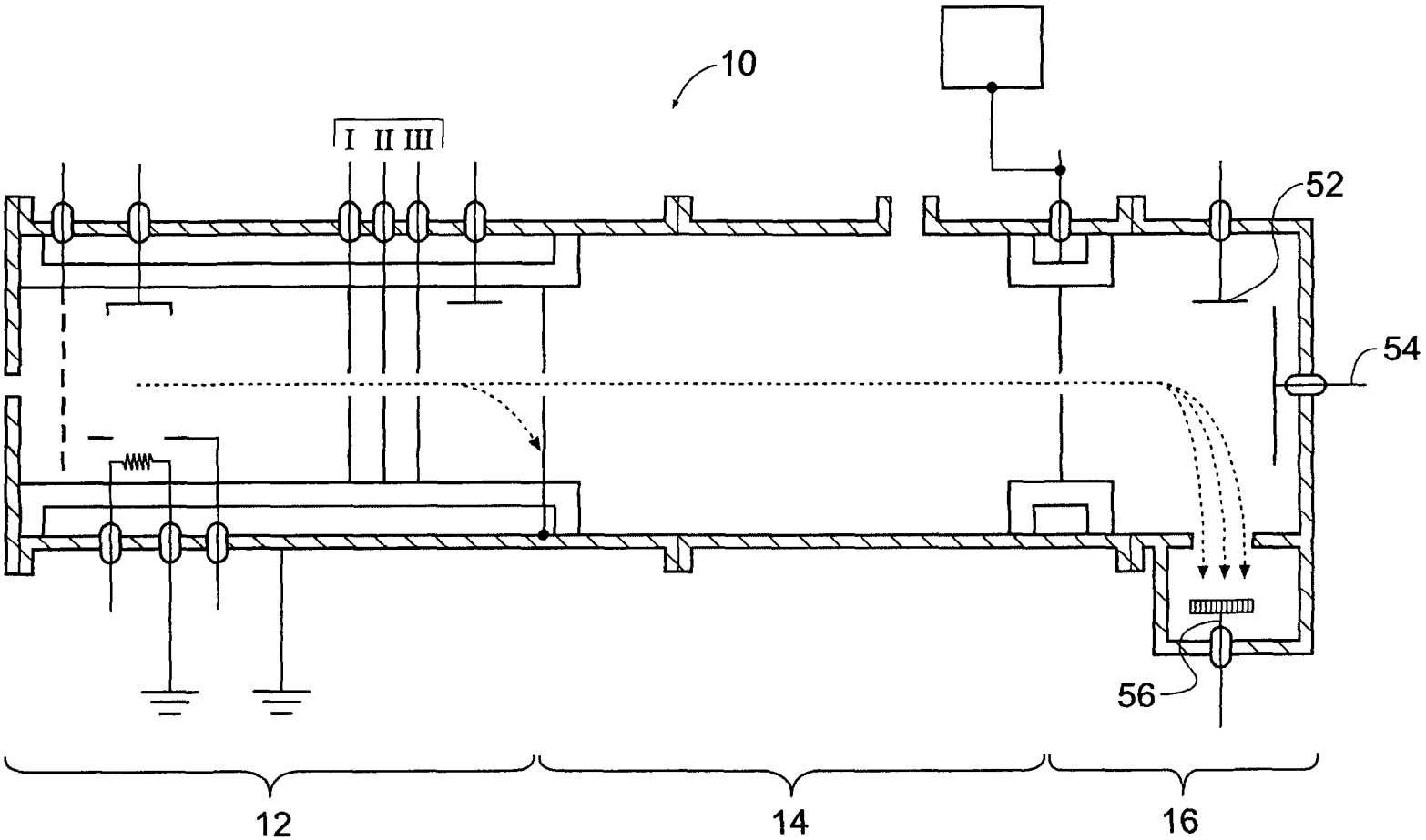
FIG. 1 (Prior Art)
FIG. 1 is a schematic cross-sectional view of a mass spectrometer according to the prior art.

In both FIG. 1 and FIG. 2, a mass spectrometer 10 is shown comprising three main components connected serially, namely an ion source 12, a mass filter 14 (sometimes referred to as an analyser) and an ion detector 16.

In the FIG. 1 design, the ion detector 16 comprises a detector array 56 and an ion disperser to disperse the ions over the detector array according to their mass-to-charge ratios. The ion disperser comprises electrodes 52, 54 that produce a curved electric field which deflects the ions onto the array by amounts depending on their energies, which in turn depend on their mass-to-charge ratios. The least energetic (lowest mass) ions are deflected through the largest angle and the most energetic ions (highest mass) through the smallest angle. Consequently ions are dispersed spatially from left to right as viewing FIG. 1. It is noted that this type of dispersion ideally requires the ions to have an infinitely thin rectangular cross-section prior to deflection. In reality, the ion beam generated by the ion source 12 and mass filter 14 has a circular cross-section and this limits resolution of the detector. The resolution can be improved by clipping the ion beam with an ion absorbing slit placed in the beam path, but this means that some of the ions are lost to the detector, thereby reducing sensitivity. A trade-off between resolution and sensitivity thus pertains.

In the FIG. 2 design, an alternative ion detector 16 is used which comprises a first detector electrode 60 which is annular with an aperture for the passage of ions. This electrode 60 acts as an energy selector. Following this, a second detector electrode 62 is located in the ion path. This is a single element detector, such as a Faraday cup. A voltage supply 63 is provided for applying voltages to the first detector electrode 60 and the second detector electrode 62. In use, the first detector electrode 60 and the second detector electrode 62 are set to a potential of Vt+Vr volts, where Vt is the time varying voltage profile as defined above, and Vr is a bias voltage selected to repel, or reflect, ions having energies less than Vr electron volts. Hence, only ions having energies equal to or greater than Vr electron volts pass through the first detector electrode 60 and reach the second detector electrode 62 for detection.

To obtain a set of mass spectrum data, Vr is initially set to zero, so that all the ions in a packet are detected. For the next packet, Vr is increased slightly to reflect the lowest energy ions, and allow the remainder to be detected. This process is repeated, with Vr increased incrementally for each packet, until the field is such that all ions are reflected and no ions are detected. The data set of detected signals for each packet can then be manipulated to yield a plot of ion current against m/z ratios, i.e. the mass spectrum. This configuration allows for a simple and compact linear construction. However, the voltage sweeping process means that a large proportion of the ions is rejected, so sensitivity is reduced. The design also suffers from noise in that there is an uninterrupted direct path along the beam axis from the ion source 12 and mass filter 14 into the detector 16. Consequently, energetic photons produced inside the ion source are incident on the detector and can cause false counts. Moreover, non-ionised atoms and molecules, so-called neutrals, that are generated by energetic ions that pass sufficiently close to the grid to be discharged, but not significantly deflected off-axis, may also impinge on the detector and cause false counts.

It would therefore be desirable to improve the detector design of mass spectrometers operating according to the constant velocity or iso-tach principle.

SUMMARY OF THE INVENTION

According to a first aspect of the invention, a mass spectrometer is provided which comprises: an ion source operable to provide an ion beam comprising a plurality of ions, each having a mass-to-charge ratio; a mass filter arranged to receive the ion beam from the ion source and configured to eject ion packets in each of which the ions have nominally equal velocities irrespective of their mass-to-charge ratios, wherein the ion packets are ejected along a beam axis; and an ion detector arranged in the beam axis so as to receive the ion packets from the mass filter, wherein the ion detector comprises a lens arrangement operable to deflect ions away from the beam axis by a distance from the beam axis inversely proportional to their mass-to-charge ratios, and further comprises a position-sensitive sensor having a plurality of channels which lie at different distances away from the beam axis, so as to detect the mass-to-charge ratios of the ions according to their distances from the beam axis.

This design combines the advantages of the two prior art detector designs in that the instrument can be made compact, since the beam line is straight, and also sensitive, since all ions can be collected in parallel.

The term inversely proportional is used to indicate that higher mass-to-charge ratio ions are deflected less and lower mass-to-charge ratio ions are deflected more, not to indicate that the deflection follows any particular mathematical function.

The term position-sensitive sensor means an ion sensor capable of determining the location at which an ion has fallen on it, at least in one dimension or direction. For some embodiments, two-dimensional position sensitivity is necessary, whereas for other embodiments one-dimensional position sensitivity is adequate.

The lens arrangement comprises first and second lenses, one of which is preferably concave and the other convex. The concave lens is preferably arranged to receive the ions before the convex lens, i.e. upstream of the convex lens along the beam line.

The lenses may be spherical, thereby separating out ions radially about the beam axis according to their mass-to-charge ratios, or cylindrical, thereby separating out ions uni-axially about the beam axis according to their mass-to-charge ratios.

The lens arrangement and the position-sensitive sensor are preferably mutually arranged such that the ions pass through a focus between the lens arrangement and the position-sensitive sensor.

A beam stop may advantageously be arranged in the path of the deflected ions to filter out uncharged particles that have propagated along the beam axis unaffected by the lens arrangement. The beam stop is conveniently arranged between two lenses of the lens arrangement. As well as being useful for filtering out uncharged particles, the beam stop may be arranged and dimensioned to extend laterally from the beam axis so as to filter out ions having a mass-to-charge ratio above a maximum threshold value. A beam mask may also be arranged in the path of the deflected ions to filter out ions having a mass-to-charge ratio below a minimum threshold value. The beam mask may be co-planar with the beam stop, or at a different position along the beam line. Generally the beam mask will define an aperture for clipping part of the beam cross-section.

The mass filter is constructed in a preferred embodiment from an electrode arrangement and a drive circuit, the drive circuit being configured to apply a time varying voltage profile having a functional form that serves to accelerate the ions to nominally equal velocities irrespective of their mass-to-charge ratios.

It will be appreciated that the magnifying power of the lens or lenses making up the lens arrangement is configurable by adjusting the lens biasing, in particular by adjusting the voltage applied to the lenses by their voltage source or sources. For example, this means that the above-mentioned minimum and maximum threshold values can be adjusted in use, as well as the overall mass-to-charge sensitivity and range of the detector.

A further aspect of the invention provides a method of mass spectrometry, the method comprising: generating an ion beam comprising a plurality of ions, each having a mass-to-charge ratio; accelerating groups of the ions in a mass filter to nominally equal velocities irrespective of their mass-to-charge ratios, thereby to form ion packets; ejecting the ion packets from the mass filter along a beam axis; deflecting ions away from the beam axis by a distance from the beam axis that is inversely proportional to their mass-to-charge ratios; and detecting the mass-to-charge ratios of the ions according to their distances from the beam axis.

The amount of deflection of the ions is preferably adjusted so that a desired range of mass-to-charge ratios is detected. The amount of deflection of the ions may be adjusted a plurality of times, so that a plurality of desired ranges of mass-to-charge ratios are detected in a single measurement cycle. The ranges may be non-overlapping, but preferably the first range is relatively broad and second and subsequent ranges are sub-ranges of the first range selected interactively responsive to the results obtained from the first range.

BRIEF DESCRIPTION OF THE DRAWINGS

For a better understanding of the invention and to show how the same may be carried into effect reference is now made by way of example to the accompanying drawings in which:

FIG. 1 is a schematic cross-sectional view of a mass spectrometer according to the prior art;

FIG. 2 is a schematic cross-sectional view of a mass spectrometer according to the prior art, having an alternative ion detector to that shown in FIG. 1;

FIG. 3 is a schematic cross-sectional view of an embodiment of a mass spectrometer according to an embodiment of the invention;

FIG. 4 is a schematic view of an ion packet in the mass spectrometer of FIG. 3;

FIG. 5 is a schematic perspective view of the ion detector assembly of FIG. 3;

FIG. 6 is a schematic front elevation of ions collected over the sensor surface of the ion detector of FIG. 3;

FIG. 7 is a schematic perspective view of the ion detector assembly of an alternative embodiment;

FIG. 8 is a schematic front elevation of ions collected over the sensor surface of the ion detector of the alternative embodiment of FIG. 7; and FIGS. 9, 10 and 11 show different functional forms of voltage pulse which may be used to effect the acceleration of all ions in an ion packet to equal velocities.

DETAILED DESCRIPTION

FIG. 3 shows a schematic cross-sectional view of a mass spectrometer according to the present invention. The mass spectrometer will be described in terms of spectrometry of a gas, but the invention is equally applicable to non-gaseous analytes.

A mass spectrometer 10 has a body 20 formed primarily from stainless steel sections which are joined together by flange joints 22 sealed by O-rings (not shown). The body 20 is elongate and hollow. A gas inlet 24 is provided at one end of the body 20. A first ion repeller electrode 26 having a mesh construction is provided across the interior of the body 20, downstream of the gas inlet 24. The mesh construction is highly permeable to gas introduced through the gas inlet 24, but acts to repel ions when an appropriate voltage is applied to it.

An ioniser comprising an electron source filament 28, an electron beam current control electrode 30 and an electron collector 32 is located downstream of the first ion repeller electrode 26. The electron source filament 28 and the current control electrode 30 are located on one side of the interior of the body 20, and the electron collector 32 is located opposite them on the other side of the interior of the body 20. The features operate in the conventional fashion, in that, by the application of appropriate currents and voltages, electrons are generated by the source filament 28, collimated by the control electrode 30, and travel in a stream across the body 20 to the collector 32.

An ion collimator in the form of an Einzel lens 34 is located downstream of the ioniser. Einzel lenses are known in the art for collimating beams of ions [2]. Downstream of the lens 34 is a second ion repeller electrode 36, which is located on one side of the body 20 only, and an ion collector electrode 38 which is annular and extends across the body 20 and has an aperture for the passage of ions. The ion collector electrode 38 and the body 10 are both grounded.

The above-mentioned features can be considered together to comprise an ion source 12 which provides ions in a form suitable for being accelerated according to their mass-to-charge ratio.

Situated downstream of the collector electrode 38 is a mass filter 14 comprising an electrode arrangement. The mass filter 14 extends for a length d, between the ion collector electrode 38 and an exponential pulse electrode 40. The exponential pulse electrode 40 is annular and has an aperture for the passage for ions. A drive circuit 41 is provided for applying time varying voltage profiles to the exponential pulse electrode 40.

An outlet 42 is provided in the part of the body 10 which defines the outer wall of the mass filter. The outlet 42 permits connection of a vacuum system by means of which the pressure in the interior of the mass spectrometer 10 can be reduced to the required operating pressure, typically no higher than $1.3\times10^{-3}$ Pa ($\sim10^{-5}$ torr), which is usual for a mass spectrometer. The outlet 42 may alternatively be situated at the end of the body 20, near the gas inlet 24.

The term "exponential box" is used in the following to refer to the mass filter 14. More specifically, the dimensions of the exponential box 14 can be defined by the length d between the ion collector electrode 38 and the exponential pulse electrode 40 and the area enclosed by these electrodes.

Downstream of the exponential pulse electrode 40 an ion detector 16 is provided. The ion detector comprises first and second electrodes 100, 102. The first and second electrodes individually act as lenses and collectively form a lens combination for the ions, wherein the first and second electrodes are arranged such that the principal axis of the instrument is coincident with the "optical" axis O of the lenses where the term optical axis is used for convenience, since it is a term of art, even though of course there is no light in the present case. The first electrode 100 acts as a diverging or concave lens, serving to diverge the incident ions of the circular cross-section collimated ion beam away from the optical axis O. The second electrode 102 acts as a converging or convex lens of sufficient power to converge the diverging ions emitted from the first electrode 100 so that they come to a focal point F, subsequent to which they diverge again before striking an detector array 108.

A beam stop 112 is arranged in the line of the principal beam path or optical axis downstream of the divergent first electrode 100 and is positioned and dimensioned such that it blocks out particles that are insensitive to the action of the divergent first electrode lens 100 and thus continue along the main beam path unaffected, but does not block out ions having mass/charge ratios of interest, these having been diverted beyond the periphery of the beam stop 112. The beam stop will thus filter out particles such as photons and non-ionised atoms and molecules.

Following basic optical theory, according to which any combination of lenses is equivalent to a single lens, it will be appreciated that more than two electrodes could be used to provide the same effect, for example 3 or 4 lenses. For the same reason a single electrode could also be used. However, use of a single electrode is generally not preferred, since it does not allow for the convenient provision of the beam stop 112.

The two electrodes 100, 102 are annular with an aperture that allows the passage of ions. First and second voltage sources 104, 106 are provided for the first and second electrodes 100 and 102 respectively. Each voltage source 104, 106 serves to apply a desired voltage to its electrodes 100, 102. During an individual measurement, the voltage applied to each electrode should be maintained constant. An individual measurement may be of a single ion packet, but more likely will be performed over an accumulation of a series of ion packets.

It will be appreciated that the voltage applied to each electrode lens 100, 102 defines the magnifying power of the lens. In turn the magnifying power of the two lenses as well as the distance from the lens combination to the detector plate 108 determine the area, or "footprint", of the ions over the detector array. The range of mass-to-charge ratios collected by the detector array can thus be varied by suitable adjustment of either the lens voltages and/or, less conveniently, the position of the detector relative to the lenses. The beam stop could also be used to block heavier, lower charge ions (higher mass/charge ratio ions) which in combination with the fact that lighter, more highly charged ions miss the detector array entirely, allows the instrument to detect only a desired range of mass-to-charge ratios. This effect can be produced by moving the beam stop along the optical axis relative to the first lens 100 or by varying the diameter of the beam stop.

To harness this effect fully a beam mask 114 with a circular aperture can be provided, for example in advance of the detector array, to block out ions below a threshold m/z ratio. The beam mask 114 may be positioned immediately in front of the detector array, as illustrated, or at some other position in the lens combination. An alternative position would be coplanar with the beam stop 112, or indeed anywhere between where the concave lens initially diverges the ions and the detector. Provision of the beam mask 114 may also be useful for the practical consideration of wishing to avoid processing complications which may arise when ions fall on the extremities of the detector array, as a result of a typical detector array being square or rectangular, rather than circular.

These adjustment features will allow the instrument to be configured differently for different targets. At one extreme, isotope detection would require a high magnification over a small range of mass-to-charge ratio, whereas at the other extreme a low magnification would be needed if an extensive sweep covering a variety of commonly occurring ions were required. It could also be envisaged to collect multiple sets of data from the same sample with different magnifications and optionally jointly process the resulting data. In a further extension, the instrument could follow up a coarse sweeps of a large range of mass-to-charge ratios with one or more subsequent fine sweeps targeted at one or more particular ranges of mass-to-charge ratios identified by the coarse sweep.

The array detector 108 is in this example a microchannel plate. The microchannel array detector 108 is a single layer two-dimensional detector. Other position-sensitive detectors could be used. A read out means 110 is provided for reading out the position of the ion impact on the array detector 108.

The electrodes 26, 32, 34, 36, 40, 100, 102 are mounted on electrode supports 44 which are fabricated from suitable insulator materials such as a ceramic material or high density polyethylene (HDPE).

Operation of the mass spectrometer 10 will now be described.

Gas which is to be analysed is admitted into the interior of the mass spectrometer 10 at low pressure via the gas inlet 24. No means of gas pressure reduction is shown in the figures, but there are many known techniques available, such as the use of membranes, capillary leaks, needle valves, etc. The gas passes through the mesh of the first ion repeller electrode 26.

The gas is then ionised by the stream of electrons from the electron source filament 28, to produce a beam of positive ions. The electrons are collected at the electron collector 32, which is an electrode set at a positive voltage with respect to the current control electrode 30, to give electrons near the axis of the ion source, shown by the dotted line in FIG. 2, an energy of about 70 eV. This is generally regarded as being about the optimum energy for electron impact ionisation, as most molecules can be ionised at this energy, but it is not so great as to produce undesirable levels of fragmentation. The precise voltage applied to the electron collector 32 would normally be set by experiment but will probably be of the order of 140 V. It should be appreciated that there are many possible designs of electron impact ionisation source and, indeed, other methods of causing ionisation. The method and construction described herein and illustrated in the accompanying drawings is merely a preferred embodiment.

Any gas which is not ionised by the stream of electrons will pass through the mass spectrometer 10 and be pumped away by the vacuum system connected to the outlet 42. A flanged connection is suitable.

The dotted line referred to above also indicates the passage of ions through the mass spectrometer 10 which follows the primary axis of the instrument which is at least approximately coincident with the principal axis of cylindrical symmetry of the instrument's main body 20.

A positive voltage is applied to the first ion repeller electrode 26, to repel the (positive) ions and direct them through the Einzel lens 34 so as to produce a narrow, parallel ion beam. A positive voltage is applied to the second ion repeller electrode 36, so that the ion beam is deflected by the second ion repeller electrode 36. The deflected ions, which follow the dotted path labelled 'A' in FIG. 2, are collected at the ion collector electrode 38, which is grounded to prevent build-up of space charge.

To allow ions to enter the mass filter, the voltage on the second ion repeller electrode 36 is periodically set to 0 V to allow a small packet of ions to be undeflected so that they enter the exponential box 14 through the aperture in the ion collector electrode 38. In this way, the second ion repeller electrode 36 and the ion collector electrode 38 form a pulse generator for generating packets of ions.

At the moment at which the ion pulse enters the exponential box 14, an exponential voltage is applied to the exponential pulse electrode 40 by the drive circuit 41. The exponential pulse is of the form $V_t=V_0 \exp(t/\tau)$ with respect to time t where $\tau$ is the time constant. The maximum voltage is designated as $V_{max}$. (Since the ions are, in this case, positively charged, the exponential pulse will be negative going. It would need to be positive going in the case of negatively charged ions). The effect on the ions of the exponentially increasing electric field resulting from the voltage pulse is to accelerate them at an increasing rate towards the exponential pulse electrode 40. Ions with the smallest mass have the lowest inertia and will be accelerated more rapidly, as will ions bearing the largest charges, so that ions with the lowest m/z ratios will experience the largest accelerations. Conversely, ions with the largest m/z ratios will experience the smallest accelerations. After t seconds all of the ions have travelled the distance d and passed the exponential pulse electrode 40, at which point the exponential voltage pulse ceases. Also, after time t seconds, all of the ions are travelling with the same velocity $v_t$ mm $s^{-1}$, where $v_t=d/\tau$, but they are spatially separated. This is a particular consequence of an exponentially increasing voltage pulse, whereby if the electrode spacing d and the shaping and timing of the voltage pulse are correctly chosen, the velocity of all the ions is the same as they leave the exponential box, regardless of the mass of the ions. The mathematical derivation of this is given in the appendix to U.S. Pat. No. 7,247,847.

A perfect exponential box will accelerate all ions to an equal velocity. In practice, the ions will typically have a range of velocities, arising from any imperfections in the system. A spread of velocities of the order of 1% can typically be expected to be achieved, which has a negligible detrimental effect on the final results from the spectrometer. Indeed, meaningful results can be obtained for larger velocity spreads than this, up to spreads of about 10%, for example up to spreads of 2%, 3%, 4%, 5%, 6%, 7%, 8%, 9% or 10%.

Typically, the distance d can be of the order of a few centimeters. For example, if d is chosen to be 3 cm, and the highest m/z ratio ions present have an m/z of 100 Th, then an exponential pulse with a time constant $\tau$ of 0.77 μs needs to be applied for 3.8 μs to allow those ions to travel the distance d. This gives a peak voltage at the end of the pulse of −2 kV.

The precise values of the voltages which need to be applied to the various electrodes depends on the exact geometry adopted in the mass spectrometer 10. An example of a set of suitable voltages is as follows:

| | | |
|---|---|---|
| Ion repeller electrode | | +10 V |
| Electron collector | | +140 V |
| Einzel lens | I | +5 V |
| | II | +3 V |
| | III | +4 V |
| Ion repeller electrode | | +60 V |

Once the ions have left the exponential box, they must be detected according to their m/z ratio, so that the mass spectrum can be derived.

The ion detector 16 shown in FIG. 3 operates as follows:

A first desired voltage is applied to the first electrode 100 using the voltage source 104. The polarity of the applied voltage is such that it is negative with respect to the ions passing through the aperture in the first electrode 100. This causes the ions moving through the aperture of the electrode 100 to be deflected radially outwards with respect to the optical axis. As show in FIG. 3 by the dotted line, the ions will diverge away from the optical axis.

Simultaneously, a second desired voltage is applied to the second electrode 102 using the voltage source 106. The polarity of the applied voltage is such that it is the positive with respect to the ions passing through the aperture in the second electrode 102. This causes the ions having moved through the first electrode 100 to be deflected radially inwards. As shown in FIG. 3 by the dotted line, the ions will converge radially toward the optical axis and at some point converge to a focal point F on the optical axis.

The beam stop 112 prevents particles which are not charged and thus unaffected by the electrode lenses 100 and 102 from reaching the microchannel array detector 108. Such particles include photons, for example in the ultraviolet energy range, non-ionised atoms or molecules (so-called energetic neutrals) and uncharged debris which may be present depending on the design of the sampling system.

Once the ions have passed through the aperture in the second electrode 102, they will continue to move along a convergent path, as shown in FIG. 3, at some point crossing at the focal point F, whereafter they diverge again until they fall on to the microchannel plate array detector 108. A microchannel plate is an ion multiplying device which gives a typical gain of $10^6$-$10^7$, i.e. a single ion can generate between $10^6$ and $10^7$ electrons which are collected as a current pulse.

The path of the ions FIG. 3 (dotted line) shows that the ions will cross over the axis at the focal point F after passing through the aperture in the second electrode 102. The position of the focus will depend on the voltage applied to the two electrodes 100, 102 and the distance between the electrodes 100, 102. Moreover, the size of the circular area over which the ions impinge on the detector will vary according to these parameters and the distance between the electrodes and the detector.

It is noted that the detector could also be placed upstream of the focal point in which case the ions would not reach a focus.

The microchannel plate array detector 108 in FIG. 3 is an array detector. The most energetic ions (i.e. the highest mass and lowest charge ions) are deflected the least amount by the two electrodes 100, 102 and so will end up toward the centre of the detector surface. Conversely the lightest ions with the highest charge state will be deflected the most toward or beyond the periphery of the detector surface.

It will be appreciated that the ions falling on to the microchannel plate array detector 108 will do so in a radial manner (i.e. a circular impact pattern with mass-to-charge ratio will be observed), since the annular aperture of the first and second electrodes will diverge and converge the ions with radial symmetry. Therefore, it is possible to map a series of radii on to the microchannel plate array. Thus, ions that impact the microchannel plate array at a specific distance from the origin, i.e. the point at which the optical axis coincides with the detector array, will have a specific m/z ratio. In other words, using polar coordinates (r, θ) with the origin as defined above, all channels at a common 'r' coordinate, or in practice range of '$r\pm\delta r$', relate to the same m/z ratio, or m/z ratio range, and are to be summed during the signal processing.

There are several techniques that can be used to read-out the position of ion impact on the detector surface, as discussed by D P Langstaff[3]. These include discrete anode and coincidence arrays, charge division and optical imaging detectors.

It will also be understood that other two-dimensional position sensitive detectors may be used, for example detectors consisting of or comprising a charged coupled device (CCDs). In principle, one-dimensional detectors could also be used in this embodiment, with the detector arranged in a strip crossing the origin, as defined above, although this would result in the majority of the ions not being collected and thereby reduce sensitivity.

The mass range and resolution of the spectrometer can be controlled by manipulation of the fixed voltages applied to the electrodes 100, 102 using the voltage supplies 104, 106. Therefore, the ion detector arrangement 16, shown in FIG. 3, could be used to collect low or high resolution spectrum. This could be carried out by collecting a low resolution spectrum using one set of fixed voltages applied to the two electrodes 100, 102 and then adjusting the two fixed voltages to effectively zoom in on a selected narrow range at a higher resolution. It will be appreciated that the resolution will still be limited by the energy spread of the ion source and the fidelity of the exponential accelerating pulse, for example.

While a result can be obtained for a single ion packet with this ion detector 16, successive packets can be accumulated so as to improve the signal to noise ratio and, thereby, the sensitivity of the spectrometer. Alternatively this ion detector can be used to obtain time-resolved data.

If the arrangement shown in FIG. 3 is implemented it should be possible to collect most, if not all, of the ion species of interest that enter the detector 14, since a two dimensional array may be used to detect the ions. By using such a two dimensional array in combination with the two electrodes shown in FIG. 3, the mass of the ions can be detected by the specific radius at which they impact the microchannel plate array surface. Furthermore, if the optional beam stop 112 in the arrangement shown in FIG. 3 is included, the ions will still impact the microchannel detector array 108 and be detected, but the unwanted non-ions should be prevented from reaching the detector.

FIG. 4 illustrates the principle of the exponential box 14 schematically. A packet of ions 44 enters the exponential box at the ion collector electrode 38, which has a zero applied voltage. The ions then travel to the exponential pulse electrode 40 to which the time varying voltage profile 46 is applied by the drive circuit 41. In this case the profile has the form $V_t=V_0 \exp(t/\tau)$ which is negative going since the ions are positive. After passing the exponential pulse electrode, the ions are spatially separated over a distance P, with the heaviest ion 48 (largest m/z ratio) at the rear and the lightest ion 50 (lowest m/z ratio) at the front. A fuller description is provided in U.S. Pat. No. 7,247,847.

FIG. 5 is a schematic perspective view of the ion detector 16. The main parts are illustrated which, in order of the direction of travel of the ions, are the first electrode lens 100 with circular aperture 101, the beam stop 112 which is a circular disc, the second electrode lens with circular aperture 103 and the array detector 108 having sensor surface 109 comprising a two-dimensional area of sensing channels, each of which is illustrated as being square in the plane orthogonal to the optical axis or beam axis O. The drawing illustrates an ion packet P1 of finite length along the beam direction at time t1 immediately prior to entering the first electrode lens 100. A number of atomic and molecular ions are schematically shown which are generally distributed within a finite range of radial distances r1 from the optical axis O, the region having a circular cross-section relative to the optical axis O. The packet P1 thus fills a volume defined by a cylinder. Once the ions enter the region of influence of the first electrode lens 100, they radially diverge occupying a gradually increasing radial distance r from the optical axis O. When passing the beam stop 112 neutral particles that are not deflected by the electric field applied by the lens 100 are stopped, as well as any ions with sufficiently large mass/charge ratio that they have not been sufficiently deflected to avoid the beam stop. As described above, this effect may be utilized deliberately to filter out ion species having mass/charge ratios that are above a maximum value of interest for the measurement in hand. The ions of the ion packet then enter the region of influence of the second electrode lens 102 and are deflected radially inwardly towards the optical axis. The ions pass through the aperture 103 in the second electrode lens 102 and, at some point between the second electrode lens 102 and the detector array 108, pass through a focus F, after which the ions diverge again before impacting the sensor surface 109 of the detector array 108 at a time t2 and as illustrated with the reference numeral P2. As indicated schematically, the ion distribution is such that ions with lower mass/charge ratios are towards the periphery of the circular area of impact, and ions of higher mass/charge ratios are situated towards the centre of the circular area of impact. In other words, the radial distance from the point of intersection of the optical axis with the sensor surface, i.e. the detection origin, to the point of impact of a given ion is a measure of that ion's mass/charge ratio. Preferably there is a linear or near linear relation between this radial distance and the mass/charge ratio. However, any known relation is acceptable, since this can then be applied during the signal processing to assign a mass/charge ratio, or more accurately a range of mass/charge ratios based on the extent of the pixel and the relation between radial distance and mass/charge ratio, to each pixel, channel or cell of the sensor array, based on the distance of that pixel, channel or cell from the origin.

FIG. 6 is a schematic front elevation of ions collected over the sensor surface 109 in which concentric rings are drawn to indicate mass/charge ratio values as well as example ions, where progressively darker shading is used to indicated heavier atom species, and single atoms, two-atom molecules and three-atom molecules are schematically depicted. No attempt is made in the schematic illustration to show the effect of charge state. The heavier ions are shown falling nearer the origin and the lighter ones farthest away from the origin.

FIG. 7 is a schematic perspective view of the principal parts of the ion detector assembly 16 of an alternative embodiment. FIG. 3 also accurately depicts this alternative embodiment which differs from the arrangement of FIG. 5 only in respect of the symmetry of the ion detector. The same reference numerals are used to indicate corresponding features. With the arrangement shown in FIG. 5, the lenses are spherical lenses, resulting in the ion beam having a circular cross-section orthogonal to the optical axis at all points along the optical axis. The alternative embodiment of FIG. 7 is instead based on cylindrical lenses. Each of the first and second lens electrodes 100 and 102 are thus formed of electrode elements with straight sides or edges, instead of the circular apertures of the embodiment of FIG. 5. Electrode lens 100 is formed by a pair of co-planar opposed electrode elements 100*a* and 100*b* with parallel straight facing edges creating an aperture 101 therebetween. Each element 100*a*, 100*b* is shown having a generally rectangular shape, but the shape distal the beam path is largely arbitrary. An equivalent arrangement for the electrode lens 100 would be to form it from a single element, like the lenses of the embodiment of FIG. 5, but having an elongate rectangular aperture. The second electrode lens 102 has similar construction to the first electrode lens 100 comprising a pair of co-planar elements 102*a* and 102*b* forming an aperture 103. The electrode lenses thus act as cylindrical lenses, in contrast to the spherical lenses of the embodiment of FIG. 5. Further, the beam stop 112 in this embodiment has straight edges or sides running parallel to each other, and also parallel to the direction of extent of the facing inner edges of the first and second electrode lenses. Moreover, if a beam mask 114 is used (not shown) in this alternative embodiment, it would also have straight edges or sides running parallel to each other, and also parallel to the direction of extent of the facing inner edges of the first and second electrode lenses.

An ion packet P1 is shown prior to entrance into the first lens and has a circular cross-section of radius r1 and finite length along the beam axis, thus forming a cylinder. On entry to the first electrode lens 100, the ions are deflected uniaxially outwardly, vertically in the figure, in a one-dimensional stretch transformation, as opposed to the radial dilation of the embodiment of FIG. 5, wherein the axis of elongation is orthogonal to the direction of extent of the inner edges of the electrode lens. This is illustrated by showing an increasingly distended cross-section. After passing through the aperture 101 of the first lens 100, the ions continue to spread apart in the vertical direction of the figure and pass the beam stop 112 which traps unwanted neutral particles, and optionally some ions, as discussed in connection with the previous embodiment. The ions of the ion packet then come under the influence of the second electrode lens 102 and are urged uniaxially inwardly ultimately coming to a line focus F at some position along the optical axis F after passing through the aperture 103 of the second electrode lens and prior to impacting on the detector array 108. After passing through the line focus, the ions of the ion packet then diverge uniaxially again and fall on the sensor area 109 of the detector array 108 at a time t2, the ions being spread vertically either side of the origin according to their mass-to-charge ratios, as shown with reference numeral P2.

FIG. 8 is a schematic front elevation of ions collected over the sensor surface of the ion detector of the alternative embodiment. Horizontal lines are drawn to indicate mass/charge ratio values as well as example ions, where progressively darker shading is used to indicated heavier atom species, and single atoms, two-atom molecules and three-atom molecules are schematically depicted. No attempt is made in the schematic illustration to show the effect of charge state. The heavier ions, with three atoms, are shown falling nearer the origin and the lightest ones, with a single atom, farthest away from the origin. It will be appreciated that distance above or below the origin is indicative of the same mass-to-charge ratio. It will further be appreciated that with this embodiment a one-dimensional detector array would have the same functionality as a two-dimensional detector array. Use of a multi-channel photomultiplier tube or other one-dimensional detector array may therefore be considered.

FIGS. 9, 10 and 11, which are reproduced from U.S. Pat. No. 7,247,847, illustrate different possible voltage profiles.

FIG. 9 shows an analogue exponential pulse, as a graph of voltage against time.

FIG. 10 shows a digitally synthesised exponential pulse, having the step features characteristic of digital signals.

FIG. 11 shows a frequency modulated pulse train of pulses of constant amplitude, short duration, and increasing repetition frequency.

The features and relative merits of these different voltage profiles are described in more detail in U.S. Pat. No. 7,247,847. A drive circuit suitable for the generation of analogue exponential pulses is also disclosed in U.S. Pat. No. 7,247,847 and can be used for the present design also. Indeed everything stated in U.S. Pat. No. 7,247,847 in relation to the drive circuit and possible variations in its design apply here also.

Furthermore, it will be appreciated that variations in design and uses described in U.S. Pat. No. 7,247,847, as well as design details omitted from the present document to avoid duplication with U.S. Pat. No. 7,247,847, apply equally to the present invention except in relation to the ion detector 16 by which the present design differs from the designs presented in U.S. Pat. No. 7,247,847. In particular, all statements made in U.S. Pat. No. 7,247,847 in relation to the ion source 12 and mass filter 14 apply equally to the present invention.

Everything described hereinabove concerns positive ion mass spectrometers. Negative ion mass spectrometry is less commonly employed but the principles of the present invention can equally well be applied to negative ions. In such a case, the polarities of the electric fields described herein would need to be reversed, including use of a positive going exponential pulse.

Further, while the design of the ion detector has been described in terms of an electrostatic lens arrangement in the above detailed description, it would be possible to provide an equivalent magnetic lens arrangement, so the invention applies more generally to an electromagnetic lens arrangement.

A mass spectrometer has thus been described which operates according to the iso-tach principle, i.e. the mass filter accelerates ions to nominally equal velocities irrespective of their mass-to-charge ratios. The mass spectrometer according to the embodiments of the invention is provided with a novel detector based on an electrostatic lens arrangement made of a concave lens followed in the beam path by a convex lens.

These lenses deflect ions away from the beam axis by a distance from the beam axis that is inversely proportional to their mass-to-charge ratios. The mass-to-charge ratio of the ions can then be determined by a suitable detector array, such as a multi-channel plate placed in the beam path. This provides a compact and sensitive instrument.

REFERENCES

[1] U.S. Pat. No. 7,247,847

[2] "Enhancement of ion transmission at low collision energies via modifications to the interface region of a 4-sector tandem mass-spectrometer", Yu W., Martin S. A., Journal of the American Society for Mass Spectroscopy, 5(5) 460-469 May 1994

[3] "An MCP based detector array with integrated electronics", D. P. Langstaff, International Journal of Mass Spectrometry volume 215, pages 1-12 (2002).

The invention claimed is:

1. A mass spectrometer comprising:

an ion source operable to provide an ion beam comprising a plurality of ions, each having a mass-to-charge ratio;

a mass filter arranged to receive the ion beam from the ion source and comprising an electrode arrangement and a drive circuit, the drive circuit being configured to apply a time varying voltage profile to accelerate groups of ions to nominally equal velocities irrespective of their mass-to-charge ratios, thereby to eject ion packets in each of which the ions have nominally equal velocities irrespective of their mass-to-charge ratios, wherein the ion packets are ejected along a beam axis; and an ion detector arranged in the beam axis so as to receive the ion packets from the mass filter, wherein the ion detector comprises a lens arrangement of a first lens and a second lens which have respective first and second optical axes arranged coincident with the beam axis, the first lens serving to diverge the incident ions of the ion beam away from the optical axis and the second lens having sufficient power to converge the diverging ions emitted from the first lens so that the ions come to a focal point, subsequent to which the ions diverge again so that the ions are deflected away from the beam axis by a distance from the beam axis inversely proportional to their mass-to-charge ratios, and further comprises a position-sensitive sensor having a plurality of channels which lie at different distances away from the beam axis, so as to detect the mass-to-charge ratios of the ions according to their distances from the beam axis.

2. The mass spectrometer of claim 1, wherein the first lens is a concave lens and the second lens is a convex lens.

3. The mass spectrometer of claim 2, wherein the concave lens is arranged to receive the ions before the convex lens.

4. The mass spectrometer of claim 1, wherein the lens arrangement is spherical, thereby separating out ions radially about the beam axis according to their mass-to-charge ratios.

5. The mass spectrometer of claim 1, wherein the lens arrangement is cylindrical, thereby separating out ions uniaxially about the beam axis according to their mass-to-charge ratios.

6. The mass spectrometer of claim 1, wherein a beam stop is arranged in the path of the deflected ions to filter out uncharged particles that have propagated along the beam axis unaffected by the lens arrangement.

7. The mass spectrometer of claim 6, wherein the beam stop is arranged and dimensioned to extend laterally from the beam axis so as to filter out ions having a mass-to-charge ratio above a maximum threshold value.

8. The mass spectrometer of claim 1, wherein a beam mask is arranged in the path of the deflected ions to filter out ions having a mass-to-charge ratio below a minimum threshold value.

9. A method of mass spectrometry, the method comprising:

generating an ion beam comprising a plurality of ions, each having a mass-to-charge ratio;

accelerating groups of the ions in a mass filter to nominally equal velocities irrespective of their mass-to-charge ratios, thereby to form ion packets, ejecting the ion packets from the mass filter along a beam axis;

diverging the ions of the ion packets away from the optical axis with a first lens having a first optical axis coincident with the beam axis;

converging the diverging ions emitted from the first lens with a second lens having a second optical axis coincident with the beam axis, so that the ions come to a focal point, subsequent to which the ions diverge again so that the ions are deflected away from the beam axis by a distance from the beam axis that is inversely proportional to their mass-to-charge ratios; and detecting the mass-to-charge ratios of the ions according to their distances from the beam axis.

10. The method of claim 9, wherein the amount of deflection of the ions is adjusted so that a desired range of mass-to-charge ratios is detected.

11. The method of claim 10, wherein the amount of deflection of the ions is adjusted a plurality of times so that a plurality of desired ranges of mass-to-charge ratios are detected in a single measurement cycle.

* * * * *